US005429037A

United States Patent [19]

Weber et al.

[11] Patent Number: 5,429,037

[45] Date of Patent: Jul. 4, 1995

[54] THREE-FUNCTION CONTROL MECHANISM EMPLOYING A SINGLE CONTROL LEVER

[75] Inventors: Herbert J. Weber, Schaumburg; Norman E. Williams, Parkridge, both of Ill.

[73] Assignee: Komatsu Dresser Company, Lincolnshire, Ill.

[21] Appl. No.: 246,878

[22] Filed: May 20, 1994

[51] Int. Cl.[6] ..... F15B 11/00; G05G 9/00

[52] U.S. Cl. ..... 91/522; 74/471 XY

[58] Field of Search ..... 91/508, 521, 522, 524; 74/471 XY; 137/636.2, 636.3

[56] References Cited

U.S. PATENT DOCUMENTS

| | | | |
|---|---|---|---|
| 3,014,377 | 12/1961 | Anderson et al. . | |
| 3,316,776 | 5/1967 | Schroter . | |
| 3,854,380 | 12/1974 | Casey | 91/521 X |
| 3,910,133 | 10/1975 | Oestmann | 74/479 |
| 4,485,689 | 12/1984 | Cambria | 74/477 |
| 4,879,922 | 11/1989 | Suzuki | 74/471 XY X |
| 5,134,895 | 8/1992 | Harmon et al. | 74/483 |
| 5,232,057 | 8/1993 | Renard | 137/632.2 X |
| 5,238,025 | 8/1993 | Preston | 74/471 XY X |
| 5,277,258 | 1/1994 | O'Dell | 172/812 |
| 5,288,198 | 2/1994 | Mozingo | 414/685 |
| 5,316,435 | 5/1994 | Mozingo | 414/685 |

FOREIGN PATENT DOCUMENTS

| | | | |
|---|---|---|---|
| 4307173 | 10/1992 | Japan | 74/471 XY |

OTHER PUBLICATIONS

Pp. 10-048, 10-049, 1056, and 10-057 entitled "Hydraulics" of parts book for Dresser model Nos. TD7G, TD8G, 100G, 125G, (Feb. 1, 1988).

Pp. 331295, 331296, 331297, 332124, 332125, and 332126 entitled "Hydraulic System" of parts book for Caterpillar model No. CAT D4H.

Pp. 3215-1, 3215-2, 3215-3 "Control Valve Assembly" of parts book for John Deere model No. 450D (Jun. 10, 1983).

Dresser Industries Inc. "Parts Manual, Models TD7G, TD8G, 100G, 125G Crawler Tractors Form 1128 200 H1", pp. 10-048, 10-049, 10-056, 10-057 (Feb. 1, 1988).

Caterpillar Tractor Co. "Parts D5H & D5H LGP Tractors Direct Drive, Powered by 3304 Engine", pp. 256-262 (Jan. 1986).

John Deere Dubuque Works "Parts Catalog John Deere 450D Crawler Bulldozer" pp. 3215-1, 3215-2, 3215-3 (Jun. 10, 1983).

*Primary Examiner*—Edward K. Look
*Assistant Examiner*—Hoang Nguyen
*Attorney, Agent, or Firm*—Edward G. Fiorito

[57] ABSTRACT

This invention provides a three-function control mechanism that employs a single control lever for controlling a first, a second and a third actuator and which may be used in connection with a bulldozer. The control mechanism includes a control bracket, a control lever, and first, second, third, and fourth bellcranks supported by the control bracket. The control mechanism further includes first, second, and third linkage that interconnect the control lever, through the bellcranks, to respective ones of the first, second, and third actuators. Due to the supporting arrangement of the control lever, bellcranks, and linkage, the control lever may be moved forward or backward, twisted clockwise or counterclockwise, or moved side to side either separately or in unison. In doing so the control lever thereby respectively actuates the first, second, and third actuators.

13 Claims, 15 Drawing Sheets

THREE-FUNCTION CONTROL MECHANISM EMPLOYING A SINGLE CONTROL LEVER

BACKGROUND OF THE INVENTION

The present invention relates generally to control mechanisms and, more specifically, to a three-function control mechanism that employs a single control lever in order to actuate or move three separate actuators. The present invention is particularly applicable for use on a work vehicle, such as a bulldozer or loader, in order to actuate hydraulic cylinders that control the positioning of a blade or shovel carried by the work vehicle.

Many bulldozers and loaders are provided with elaborate control systems that allow an operator to adjust or change the position of the blade or shovel. Without limiting the applicability of the present invention to the control of a bulldozer blade, the invention will be described hereinafter in connection with a bulldozer, it being understood that the invention may be applicable to other work vehicles or other apparatus. Typically, the adjustments made by existing control systems to the bulldozer blade may include the following three movements: (1) raising and lowering of the blade; (2) the tilting of the blade about a first axis; or (3) angling of the blade about a second, mutually-perpendicular axis.

A typical bulldozer usually will have hydraulic cylinders that are coupled to the blade and that may be extended or retracted to change the position of the blade. The flow of hydraulic fluid to and from the hydraulic cylinders is typically controlled by corresponding valve systems that are actuated by movement of one or more control lever by the operator. Manipulation of more than one control lever in order to change the position of the blade can, however, be cumbersome to the operator. Furthermore, in one known control system where a single control lever is used, a significant number of parts are employed making the system relatively expensive to manufacture and assemble.

It is therefore desirable and an object of the present invention to provide a hydraulic control mechanism which features a single lever for actuating the valve systems. It is a further object of the present invention to provide a hydraulic control mechanism that is relatively uncomplicated having relatively few main parts and which can carry out each of the three functions (lift, tilt, and angle) independently or in unison.

SUMMARY OF THE INVENTION

In accordance with the present invention, a three-function control mechanism is provided for controlling a first, a second and a third actuator. The three-function control mechanism may be used on a bulldozer to actuate the bulldozers hydraulic cylinders that control the positioning of the bulldozer blade. The three function control mechanism comprises a control bracket, a control lever, and first, second, third and fourth bellcranks. A first end of the handle shaft is rotatably mounted to the first bellcrank such that the handle shaft can rotate about a first axis.

The second bellcrank is rotatably mounted to the first bellcrank such that the first and the second bellcranks can rotate about a second axis with respect to one another. The second bellcrank further is rotatably mounted to the control bracket such that the second bellcrank may rotate about a third axis with respect to the control bracket. The third bellcrank is pivotably coupled to the second bellcrank and is further rotatably mounted to the control bracket such that the third bellcrank can rotate about a fourth axis with respect to the control bracket. The fourth bellcrank is pivotably coupled to the handle shaft and is further rotatably mounted to the control bracket such that the fourth bellcrank can rotate about a fifth axis with respect to the control bracket.

The three-function control mechanism further includes first, second and third linkage. A first end of the first linkage is mounted to the first bellcrank, and a second end of the first linkage is adapted to be coupled to the first actuator. A first end of the second linkage is mounted to the third bellcrank, and the second end of the second linkage is adapted to be coupled to the second actuator. A first end of the third linkage is mounted to the fourth bellcrank, and a second end of the third linkage is adapted to be coupled to the third actuator.

The control lever may be moved in first and second opposing directions such that the control lever and the first bellcrank rotate about the second axis causing the first linkage and first actuator to move. The control lever may also be moved in third and fourth opposing directions such that the control lever and second bellcrank rotate about the third axis causing the third bellcrank, the second linkage, and the second actuator to move, and the control lever may be moved in fifth and sixth directions such that the control lever rotates about the first axis causing the fourth bellcrank, third linkage and third actuator to move.

In a preferred embodiment of the invention the first linkage comprises a link, a first swivel joint and a second swivel joint. The first swivel joint is positioned at the first end of the first linkage and interconnects the link and the first bellcrank, and the second swivel joint is positioned at the second end of the first linkage interconnecting the link and the first actuator. Preferably, the first swivel joint is substantially aligned with the third axis except when the control lever is moved in either the first or second direction away from a neutral position wherein the control lever has not been moved in any direction.

BRIEF DESCRIPTION OF THE DRAWINGS

Other advantages and features of the invention will become more apparent with reference to the following detailed description of a preferred embodiment of the invention in connection with the accompanying drawings, wherein like reference numerals have been applied to like elements, in which.

Throughout the specification, the terms "forward", "rearward", "side", "right", and "left", "up", and "down" are used for convenience in describing the invention. These terms are not intended to be limiting.

DETAILED DESCRIPTION

I. The Bulldozer and Blade

Figure 1:
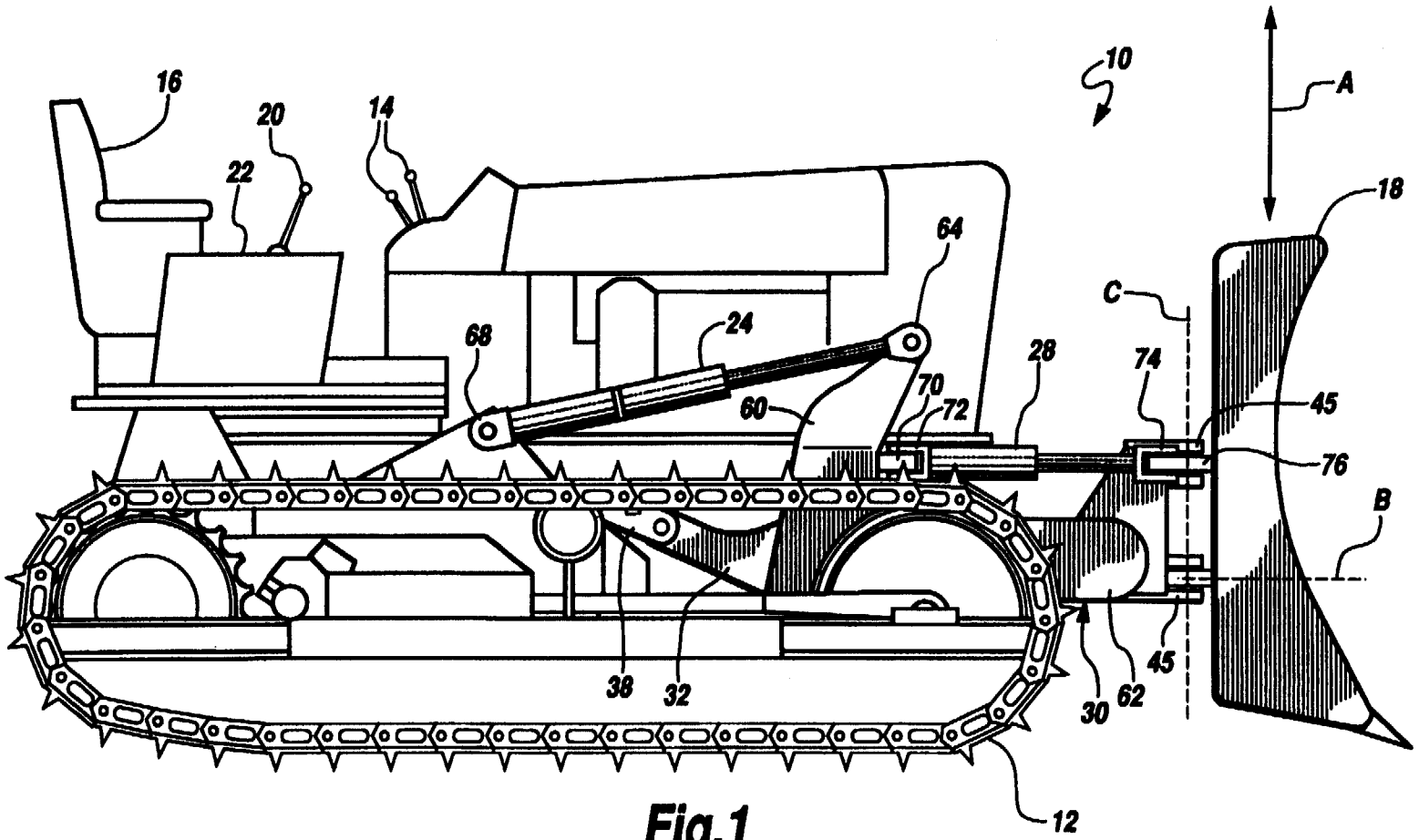
FIG. 1 is a side view of a bulldozer incorporating the principles of the present invention.

FIG. 1 illustrates a bulldozer 10 having a pair of continuous drive tracks for moving the bulldozer 10 forward or backward as well as for turning the bulldozer 10. Only one track 12 is shown with the other being positioned on the opposite side of the bulldozer. Control levers 14 are provided near the operator's seat 16 to control the operation of the drive tracks 12 and thereby the movement of the bulldozer 10.

Figure 2A:
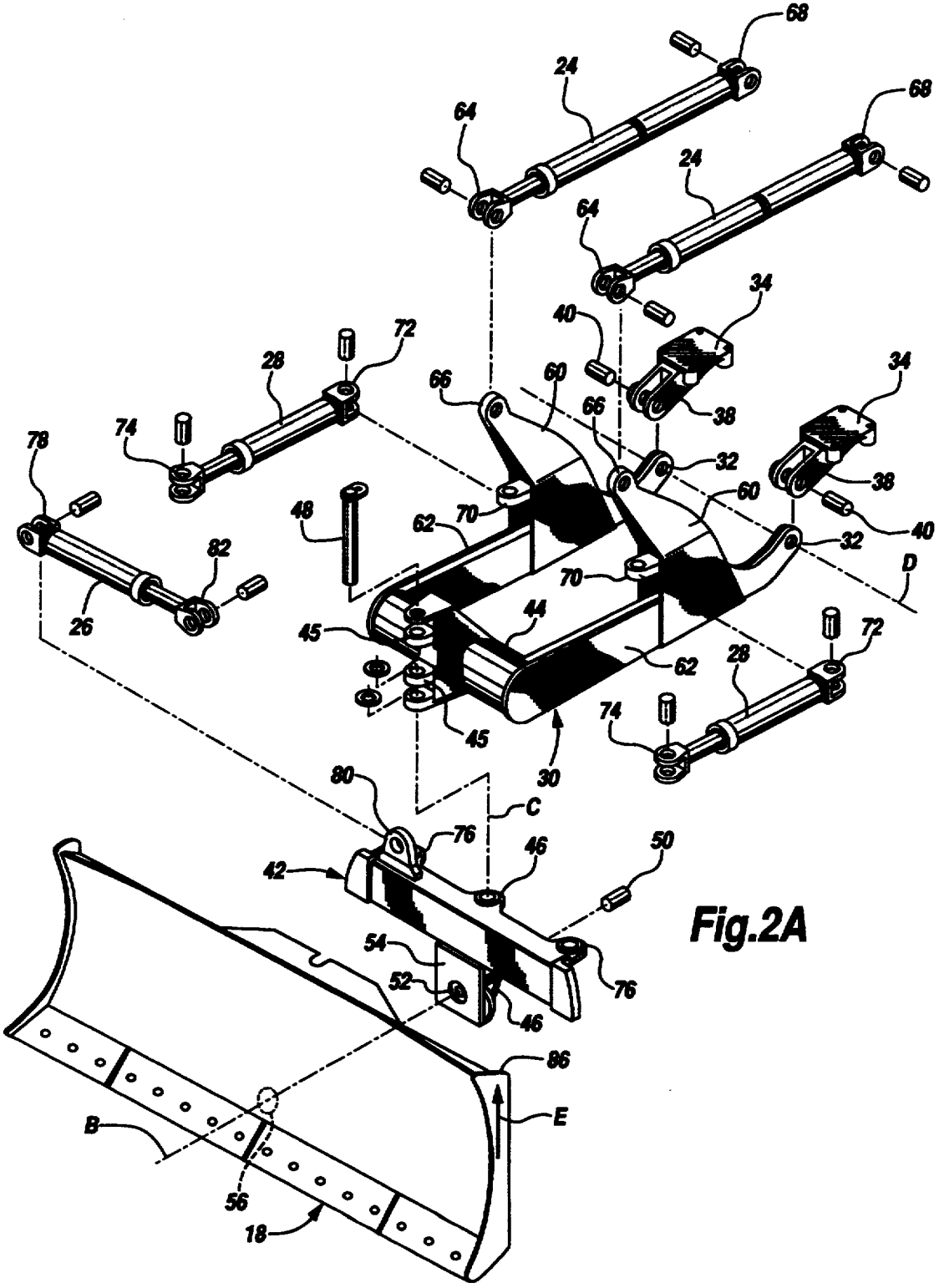
FIG. 2A is an enlarged exploded perspective view of the forward end of the bulldozer of FIG. 1 turned approximately 180 degrees, illustrating the bulldozer blade, hydraulic cylinders, and blade support assembly.

Located at the forward end of the bulldozer 10 is a blade 18 that may be lifted up and down as indicated by arrow A, tilted to one side or another about generally-horizontal axis B, and angled to one side or another about generally-vertical axis C. The lifting, tilting, or angling of the blade 18 is controlled by manipulating a control handle 20 that is coupled to a three-function control mechanism (not shown in FIG. 1) contained in a housing 22. The three-function control mechanism is coupled to a series of lift, tilt, and angle hydraulic cylinders 24, 26, and 28, respectively, that may be selectively actuated by operation of the handle 20 in order to adjust the position of the blade 18 (tilt cylinder 26 is shown in FIG. 2A). Preferably, each of the hydraulic cylinders 24, 26, and 28 is a conventional, dual-acting type cylinder that has first and second fluid chambers which may be selectively filled with hydraulic fluid to cause the cylinder to either extend or retract.

A. The Blade Support Assembly

Figure 2B:
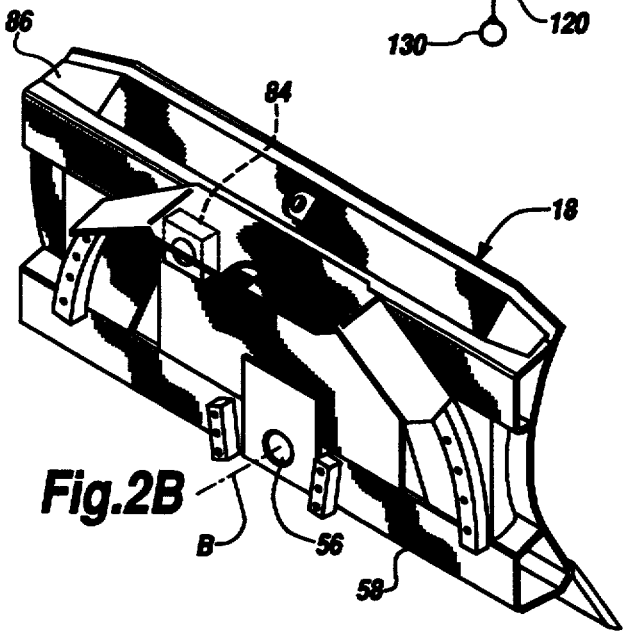
FIG. 2B is a perspective view of the bulldozer blade illustrating the backside of the blade.

With reference to FIGS. 2A and 2B (FIG. 2A is turned approximately 180 degrees with respect to FIG. 1), the bulldozer 10 includes a substantially U-shaped frame 30 that supports the blade 18. The free ends 32 of the U-shaped frame 30 are pivotably mounted to respective trunnions 34 that are fixed to the body of the bulldozer 10. The trunnions 34 are each provided with a clevis 38 in which a respective end 32 of the U-shaped frame is inserted and held in place by a respective pin 40.

An angling frame 42 is pivotably mounted to the cross-leg 44 of the U-shaped frame 30. The cross-leg 44 of the U-shaped frame 30 is provided with two vertically-spaced clevises 45 which receive respective horizontal tab extensions 46 provided on the angling frame 42. A pin 48 holds the tab extensions 46 in place.

The blade 18 in turn is pivotably mounted to the angling frame 38 by a pin 50 that passes through both a hole 52 provided in a lower portion 54 of the angling frame 42 and a hole 56 provided in a lower bracket 58 (FIG. 2B) attached to the back side of the blade 18.

As a result of the aforementioned mounting arrangement, the blade 18, along with the U-shaped frame 30, may pivot about horizontal axis D, thereby allowing the blade 18 to be lifted or lowered. Furthermore, the blade 18 may be pivoted about generally horizontal axis B, thereby allowing the blade 18 to be tilted. The blade 18 may also be pivoted about generally vertical axis C, thereby allowing the blade 18 to be angled to the left or right.

The U-shaped frame 30 includes a pair of posts 60 that extend upwardly from respective side legs 62 of the U-shaped frame 30. One end 64 of each lift cylinder 24 is pivotably mounted to a respective end 66 of the posts 60. The opposing ends 68 of the lift cylinders 24 are pivotably mounted to the body of the bulldozer 10 so that the lift cylinders 24 extend rearwardly from the posts 60 on either side of the bulldozer 10.

The posts 60 are each provided with a horizontal tab extension 70 to which respective ends 72 of the angle cylinders 28 are pivotably attached. The opposing ends 74 of the angle cylinders 28 are pivotably mounted to respective horizontal tab extensions 76 provided on the angling frame 42 so that the angle cylinders 28 extend forwardly from the posts 60 on either side of the bulldozer 10.

The tilt cylinder 26 extends traversely across a portion of the back side of the blade 18. One end 78 of the tilt cylinder 26 is pivotably mounted to a vertical tab extension 80 provided on the right upper portion of the angling frame 42. The opposing end 82 of the tilt cylinder 28 is pivotably mounted to a lug 84 (FIG. 2B) attached to the left upper portion of the back side of the blade 18.

1. Lifting of Blade

Lifting of the blade 18 is accomplished by moving both of the lift cylinders 24 into their retracted positions, and lowering of the blade 18 is accomplished by extending the lift cylinders 24. As the lift cylinders 24 retract, the posts 60 of the U-shaped frame 30 are pulled backward causing the U-shaped frame 30 to pivot about axis D and the blade 18 to move upwardly as indicated by arrow A in FIG. 1. The U-shaped frame 30 pivots in the opposite direction when the lift cylinders 24 extend and the blade 18 is thereby lowered.

2. Tilting of Blade

Tilting of the blade 18 is accomplished by extending or retracting the tilt cylinder 26 which causes the left upper comer 86 of the blade 18 to raise or lower. As the tilt cylinder extends, it forces the left upper corner 86 of the blade 18 to raise, as indicated by arrow E in FIG. 2A. The entire blade 18 thereby pivots about the B axis with respect to the angling frame 42. Retraction of the tilt cylinder 26 causes the left upper corner 86 to lower and the entire blade to pivot in the opposite direction.

3. Angling of Blade

Angling of the blade 18 to the left side or right side is accomplished by retracting one of the angle cylinders 28 and extending the other so that one side of the blade 18 is moved backward and the other side is moved forward as the blade 18 pivots about axis C. For example, the blade 18 may be angled to the left (as viewed from the operator's seat 16) by retracting the left angle cylinder 28 (the cylinder on the operator's left side) and extending the right angle cylinder 28 (the cylinder on the operator's right side). Angling of the blade 18 to the right may be accomplished by retracting the right angle cylinder 28 and extending the left angle cylinder.

II. Hydraulic Valve Unit

Figure 3:
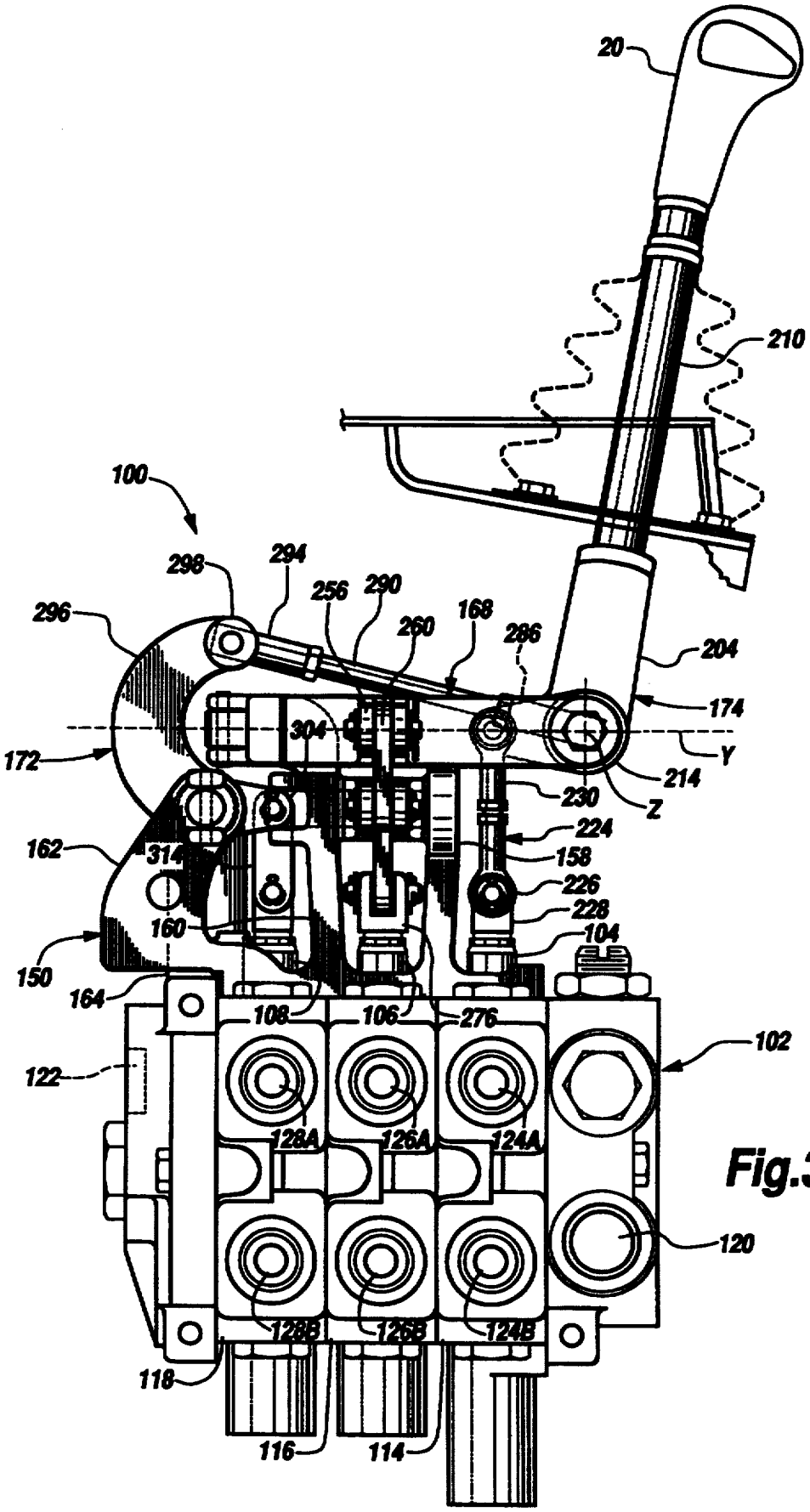
FIG. 3 is a side elevational view of a three-function control mechanism and hydraulic valve unit for controlling the position of the bulldozer blade and hydraulic cylinders according to the present invention.

FIG. 3 illustrates the three-function control mechanism 100 and a hydraulic valve unit 102 that control the extension and retraction of the lift, tilt, and angle hydraulic cylinders 24, 26, and 28, respectively, and, therefore, control the lifting, tilting, and angling of the blade 18. The hydraulic valve unit 102 comprises three separate valve spools: lift valve spool 104, tilt valve spool 106, and angle valve spool 108, that control the flow of hydraulic fluid to either the first or the second chamber of the dual-acting hydraulic cylinders 24, 26, and 28. By selectively moving the handle 20, the three-function control mechanism 100 can either individually or simultaneously raise or lower the three spools 104, 106, and 108 and thereby control the flow of hydraulic fluid to the hydraulic cylinders 24, 26, and 28.

As explained in more detail further below, movement of the handle 20 forward (or rearward) causes the lift valve spool 104 to raise (or lower), the hydraulic fluid to flow so as to extend (or retract) the lift cylinders 24, and the blade 18 to consequently lower (or raise). Movement of the handle 20 to the left (or right) (as viewed by the operator) causes the tilt valve spool 106 to move down (or up), hydraulic fluid to flow so as to retract (or extend) the tilt cylinder 26, and the blade 18 to tilt to the left (or right), i.e., the left upper comer 86 of the blade 18 to lower (or raise). Twisting of the handle clockwise (or counterclockwise) (as viewed from above) causes the angle valve spool 108 to move down (or up), hydraulic fluid to flow so as to extend (or retract) the left angle cylinder and retract (or extend) the fight angle cylinder 28, and the blade 18 to angle to the right (or left).

The hydraulic valve unit 102 includes three housings 114, 116, and 118 that are joined together and house, respectively, the lift valve spool 104, tilt valve spool 106, and angle valve spool 108. Hydraulic fluid enters the hydraulic valve unit 102 through an inlet port 120 provided at one end of the unit 102 and exits through either an outlet port 122 provided at the opposing end or through selective working ports provided in the three housings 114, 116, and 118.

Lift housing 114 is provided with two working ports 124A and 124B. Port 124A is fluidically coupled to the first chambers of both the left and right lift cylinders 24, and port 124B is fluidically coupled to the second chambers of the left and right lift cylinders 24.

Tilt housing 116 is provided with two working ports 126A and 126B. Port 126A is fluidically coupled to the first chamber of the tilt cylinder 26, and port 126B is fluidically coupled to the second- chamber of the tilt cylinder 26.

Angle housing 118 is provided with two working ports 128A and 128B. Port 128A is fluidically coupled to the first chamber of the left angle cylinder 28 and the second chamber of the right angle cylinder 28, and port 128B is fluidically coupled to the second chamber of the left angle cylinder 28 and the first chamber of the right angle cylinder 28.

Figure 4:
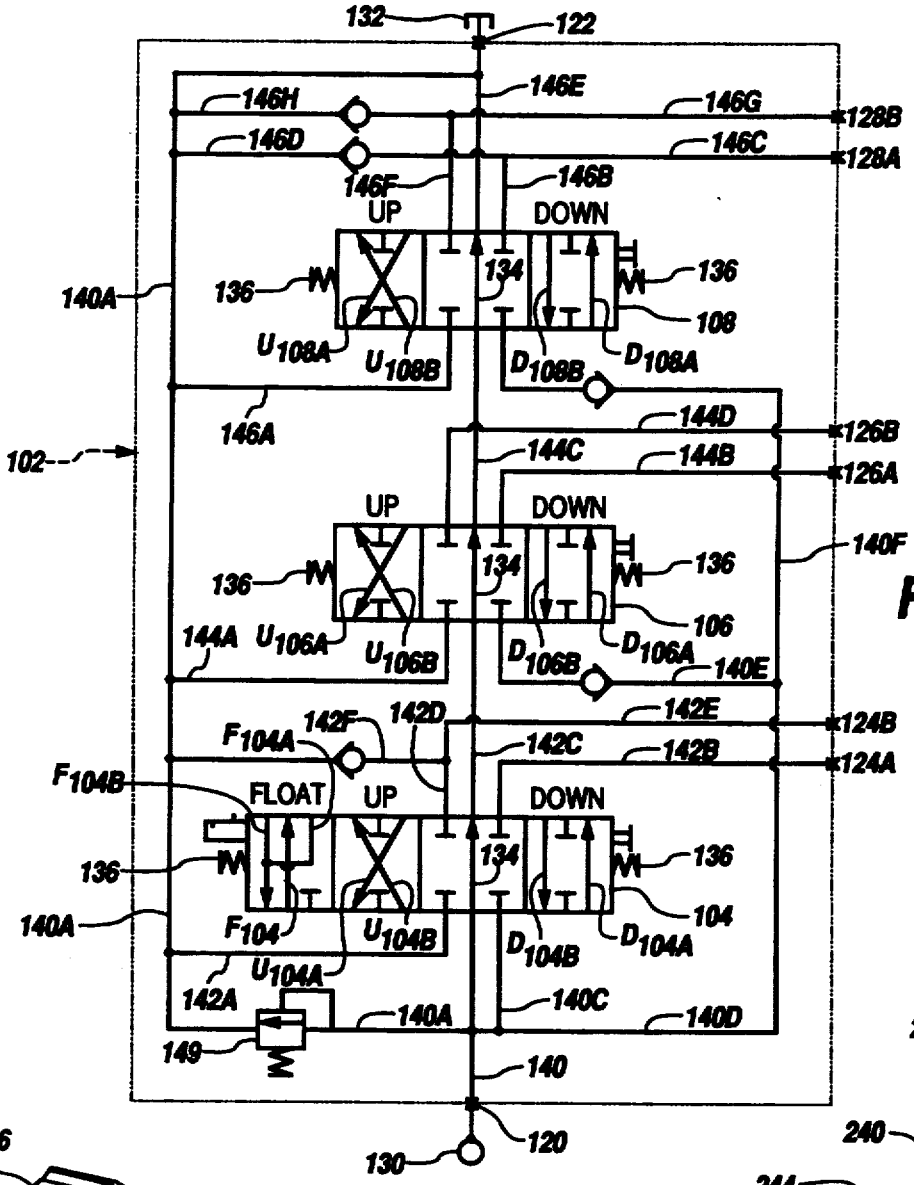
FIG. 4 is a schematic view of the hydraulic valve unit.

FIG. 4 schematically illustrates the hydraulic valve unit 102. The inlet port 120 of the hydraulic valve unit is shown fluidically coupled to a hydraulic fluid source 130 that pumps hydraulic fluid into the unit 102, and the outlet port 122 is shown fluidically coupled to a hydraulic fluid sink or main reservoir 132. Each of the lift, tilt and angle valve spools 104, 106, and 108 can be moved into one of three positions: an up or down position, as indicated by the reference terms "UP" and "DOWN" in FIG. 4, or a neutral position, the position in which all three spools 104, 106, and 108 are shown in FIG. 4. The lift valve spool 104 can additionally be moved into a "float" position, as represented by the reference term "FLOAT".

With each of the spools 104, 106, and 108 in its neutral position as shown in FIG. 4, hydraulic fluid enters the unit 102 through the inlet port 120, passes through the spools 104, 106, and 108, as shown by arrows 134, and exits the unit 102 through the outlet port 122. Each of the spools 104, 106, and 108 is biased into its neutral position by spring assemblies 136 in a conventional manner. Accordingly, if a particular spool 104, 106, or 108 is not being forced into its up or down position by the handle 20, then the respective spring assembly 136 will return and hold the spool in its neutral position.

The hydraulic valve unit 102 further includes a number of fluid lines interconnecting the fluid source 130, main reservoir 132, and working ports 124A, 124B, 126A, 126B, 128A, 128B with the valve spools 104, 106, and 108. The following outlines the flow of hydraulic fluid through the hydraulic valve unit 102 dependent upon the position of a valve spool.

1. Down Position of Lift Valve Spool 104 (Handle 20 in rearward position):

A. Hydraulic fluid flows from fluid source 130 through fluid lines 140 and 140C, through lift valve spool 104 as indicated by arrow $D_{104A}$, through fluid line 142B, and out working port 124A to the first chambers of the hydraulic cylinders 24 causing the cylinders 24 to retract and the blade 18 to raise up;

B. Hydraulic fluid flows in working port 124B from the second chambers of the hydraulic cylinders 24, through fluid lines 142E and 142D, through lift valve spool 104 as indicated by arrow $D_{104B}$, through fluid lines 142A and 140A, and out outlet port 122 to main reservoir 132.

2. Up Position of Lift Valve Spool 104 (Handle 20 in forward position):

A. Hydraulic fluid flows from fluid source 130 through fluid lines 140 and 140C, through lift valve spool 104 as indicated by arrow $U_{104B}$, through fluid lines 142D and 142E, and out working port 124B to the second chambers of the hydraulic cylinders 24 causing the cylinders 24 to extend and the blade 18 to lower;

B. Hydraulic fluid flows in working port 124A from the first chambers of the hydraulic cylinders 24, through fluid line 142B, through lift valve spool 104 as indicated by arrow $U_{104A}$, through fluid lines 142A and 140A, and out outlet port 122 to main reservoir 132.

3. Float Position of Lift Valve Spool 104 (Handle 20 in maximum forward position):

A. Hydraulic fluid flows from fluid source 130, through fluid lines 140 and 140B, through lift valve spool 104 as indicated by arrow $F_{104}$, and, provided the tilt valve spool 106 and angle valve spool 108 are in their neutral positions, through tilt valve spool 106, fluid line 144C, angle valve spool 108, and fluid line 146E, and out outlet port 122 to main reservoir 132;

B. Hydraulic fluid flows in both working ports 124A and 124B from both the first and second chambers of the hydraulic cylinders 24, through fluid lines 142B, 142E and 142D, through valve spool 104 as indicated by arrows $F_{104A}$ and $F_{104B}$, through fluid lines 142A and 140A, and out outlet 122 to main reservoir 132.

4. Down Position of Tilt Valve Spool 106 (Handle 20 moved to operator's left side):

A. Hydraulic fluid flows from fluid source 130 through fluid lines 140, 140D and 140E, through tilt valve spool 106 as indicated by arrow $D_{106A}$, through fluid line 144B, and out working port 126A to the first chamber of hydraulic cylinder 26 causing cylinder 26 to retract and the upper left corner 86 of the blade 18 to lower;

B. Hydraulic fluid flows in working port 126B from the second chamber of the hydraulic cylinder 26, through fluid line 144D, through tilt valve spool 106 as indicated by arrow $D_{106B}$, through fluid lines 144A and 140A, and out outlet port 122 to main reservoir 132.

5. Up Position Tilt Valve Spool 106 (Handle 20 moved to operator's right side):

A. Hydraulic fluid flows from fluid source 130 through fluid lines 140, 140D and 140E, through tilt valve spool 106 as indicated by arrow $U_{106B}$, through fluid line 144D, and out working port 126B to the second chamber of the hydraulic cylinder 26 causing the cylinder 26 to extend and the upper left corner of the blade 18 to raise;

B. Hydraulic fluid flows in working port 126A from the first chamber of the hydraulic cylinder 26, through fluid line 144B, through tilt valve spool 106 as indicated by arrow $U_{106A}$, through fluid lines 144A and 140A, and out outlet port 122 to main reservoir 132.

6. Down Position of Angle Valve Spool 108 (Handle 20 twisted clockwise):

A. Hydraulic fluid flows from fluid source 130 through fluid lines 140, 140D and 140F, through angle valve spool 108 as indicated by arrow $D_{108A}$, through fluid lines 146B and 146C, and out working port 128A to the first chamber of the left angle hydraulic cylinder 28 causing the left cylinder to extend and to the second chamber of the right angle hydraulic cylinder 28 causing the right cylinder to retract and the blade 18 to angle to the right;

B. Hydraulic fluid flows in working port 128B from the second chamber of the left angle hydraulic cylinder 28 and from the first chamber of the right angle hydraulic cylinder 28, through fluid lines 146G and 146F, through angle valve spool 108 as indicated by arrow $D_{108B}$, through fluid lines 146A and 140A, and out outlet port 122 to main reservoir 132.

7. Up Position of Angle Valve Spool 108 (Handle 20 twisted counterclockwise):

A. Hydraulic fluid flows from fluid source 130 through fluid lines 140, 140D and 140F, through angle spool 108 as indicated by arrow $U_{108B}$, through fluid lines 146F and 146G, and out working port 128B to the second chamber of the left angle hydraulic cylinder 28 causing the left cylinder 28 to retract and to the first chamber of the right angle hydraulic cylinder 28 causing the fight cylinder 28 to extend and the blade 18 to angle to the left;

B. Hydraulic fluid flows in working port 128A from the first chamber of the first hydraulic cylinder 28 and from the second chamber of the second hydraulic cylinder 28, through fluid fines 146C and 146B, through angle valve spool 108 as indicated by arrow $U_{108A}$, through fluid lines 146A and 140A, and out outlet port 122 to main reservoir 132.

Check valves 148 are provided in fluid lines 140E, 140D, 142F, 146D, and 146H in order to prevent the reverse flow of hydraulic fluid through these lines. In addition, a bypass valve 149 is provided in fluid line 140A to allow the release of fluid to the main reservoir 132 if there is a an excessive build up of fluid pressure in fluid lines 140C, 140D, 140E, and 140F resulting in an excessive build up of fluid pressure in fluid line 140A upstream of the bypass valve.

So long as the valve spools 104, 106, and 108 are actuated by the handle 20 (i.e. held in either their up or down position), hydraulic fluid will continue to flow to and from the corresponding cylinder (or cylinders) until the cylinder (or cylinders) is fully extended or retracted. If, after the cylinder (or cylinders) is fully extended or retracted, the handle 20 is still held in its operating position, hydraulic fluid will be redirected inside the valve unit 102 to the main reservoir 132 by the bypass valve 149.

The FLOAT position of the valve spool 104 corresponds to a floating position of the blade 18. In such a position, the handle 20 is moved to an extreme forward position and held in place by a detent (not shown).

Hydraulic fluid is not trapped in the cylinders 24. Consequently, the blade 18 lowers and is allowed to float, not being held in any set position. This floating feature is found in many conventional bulldozers and is desirable when, for example, the bulldozer moves in reverse and the blade 18 thereby is allowed to drag along the ground and can work to smooth the ground.

III. Three-Function Control Mechanism

Figure 5A:
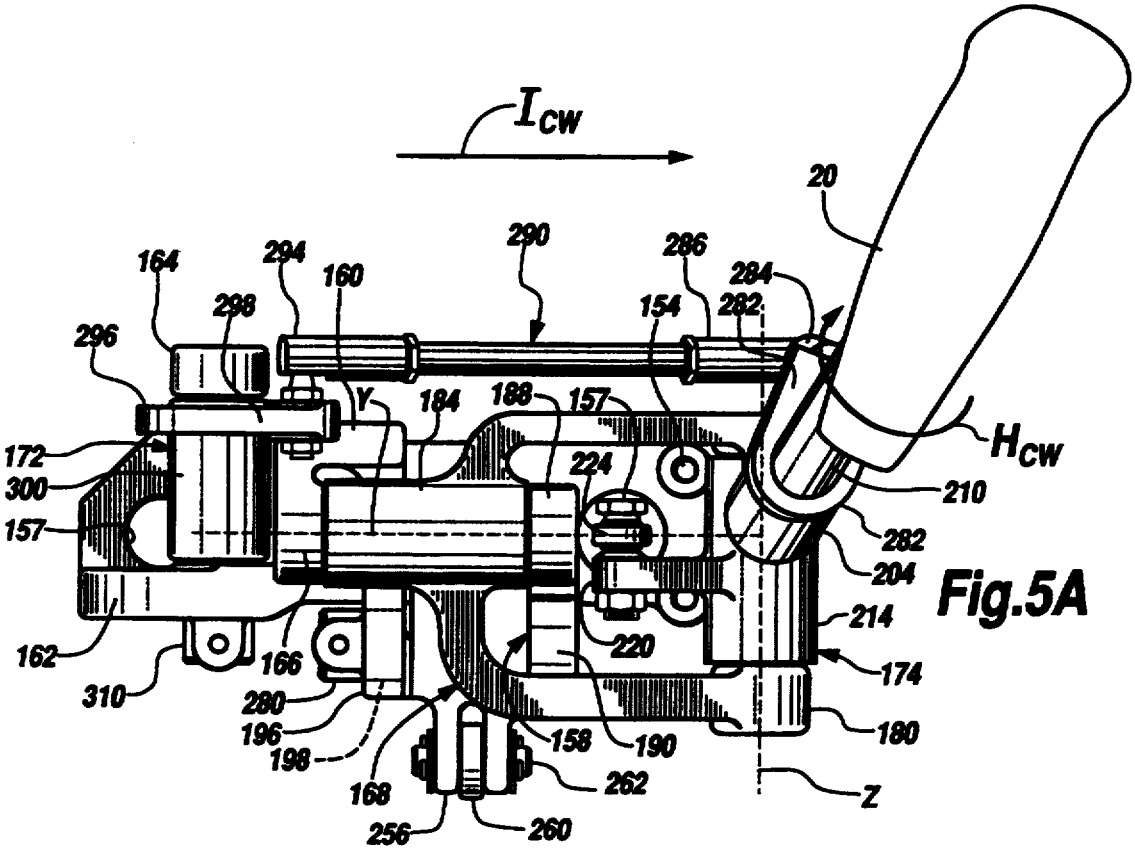
FIG. 5A is a top plan view of the three-function control mechanism of FIG. 3 illustrating the operator handle twisted clockwise.
Figure 6:
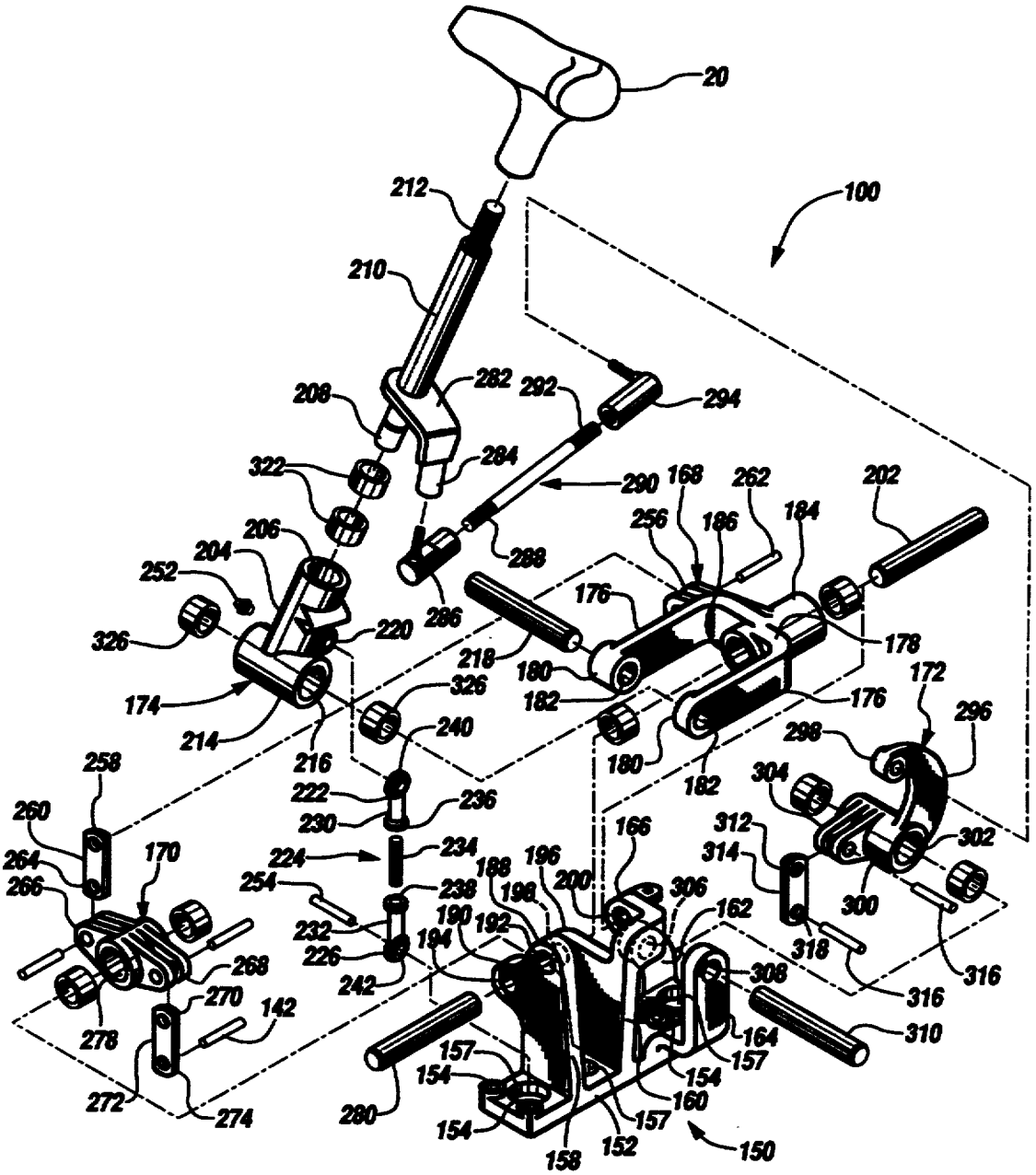
FIG. 6 is an exploded perspective view of the three-function control mechanism of FIG. 3.

The three-function control mechanism 100 will now be described in more detail. The term "three-function" in the phrase "three-function control mechanism" refers to the "lift", "tilt", and "angle" functions of the hydraulic valve unit 102 corresponding to the lifting, tilting, and angling of the blade. With reference to FIGS. 3, 5A, and 6, the three-function control mechanism 100 comprises a control bracket 150 that is bolted to the top of the hydraulic valve unit 102. The control bracket 150 has a generally horizontal bottom portion 152 that is provided with four apertures 154 through which bolts (not shown) pass in order to attach the control bracket 150 to the top of the hydraulic valve unit 102. Additionally, the horizontal bottom portion 152 is provided with three larger holes 157 through which respective valves spools 104, 106, and 108 pass.

The control bracket 150 further has first, second, third, and fourth support members 158, 160, 162, and 164, respectively, that project upwardly from the bottom portion 152 of the control bracket. Whereas the first 158, third 162, and fourth 164 support members are generally flat, the second support member 160 includes an offset extension 166. The support members 158, 160, 162, and 164 support three bell cranks: a lift and tilt bellcrank 168, a tilt bellcrank 170, and an angle bellcrank 172. Lift and tilt bellcrank further supports a lift bellcrank 174.

A. Lift Function

As the names imply, the lilt and tilt bellcrank 168 and the lift bellcrank 174 are associated with the lilt function of the three-function control mechanism 100. With reference to FIGS. 3, 6, 7A and 7B, and 8, the remaining structure associated with the lift function, as well as the operation of the lilt function will be discussed.

The lift and tilt bellcrank 168 has a generally U-shaped configuration with opposing side legs 176 interconnected by a cross-leg 178. The ends 180 of the side legs 176 are provided with apertures 182, and the cross-leg 178 is provided with a tubular member 184 with a through hole 186. When the control mechanism 100 is fully assembled, the tubular member 184 of the lift and tilt bellcrank 168 is pivotably mounted to the control bracket 150 between the first support member 158 and the offset portion 166 of the second support 160.

The first support member 158 has an upper projection 188 and a side projection 190. Each projection 188 and 190 is provided with a respective aperture 192 and 194. In addition, the second support 160 has a side projection 196. Both the side projection 196 and the offset extension 166 of the second support member 160 are provided with apertures 198 and 200, respectively.

The tubular member 184 of the lift and tilt bellcrank 168 is positioned between the upper projection 188 of the first support member 158 and the offset extension 166 of the second support member 160. A pin 202 passing through the aperture 192 of the upper projection 188, the aperture 200 of the offset extension 166, and the through hole 186 of the tubular member 184 holds the lift and tilt bellcrank 168 in place.

The lift bellcrank 174 has a generally T-shaped configuration with an upright leg 204 having a bore 206 that rotatably receives one end 208 of a handle shaft 210. The opposite end 212 of the handle shaft 210 supports the handle 20. The lift bellcrank 174 has a cross leg 214 having a through hole 216. The cross leg 214 is pivotably mounted between the ends 180 of the side legs 176 of the lift and tilt bellcrank 168. A pin 218 passing through both the apertures 182 of the side-leg ends 180 and the through hole 216 of the lift bellcrank 174 holds the lift bellcrank 174 in position. Accordingly, when the handle 20 and shaft 210 are moved rearward or forward as indicated by arrows $L_R$ and $L_F$ in FIGS. 7A and 7B, the lift bellcrank 174 is able to pivot about pin 218 with respect to the lift and tilt bellcrank 168. The pivot axis of the pin 218 is represented by axis Z throughout the drawings.

A tab member 220 projecting from the side of the lift bellcrank 174 supportsone end 222 of a lift link 224. The lift link 224 is configured to function essentially like a swivel whereby the link 224 may move with respect to either or both the tab member 220 and the upper end 228 of the lift spool 104. The opposite end 226 of the lift link 224 is coupled to the upper end 228 of the lift spool 104. The lift link 224 comprises three major parts: an upper link swivel part 230, lower link swivel part 232, and an internal, threaded link part 234. Both the upper and lower swivel link parts 230 and 232 are provided with threaded bores 236 and 238 that threadingly receive respective ends of the threaded link part 234. This three-part threaded configuration allows the length of the lift link 224 to be adjusted as needed.

Figure 8:
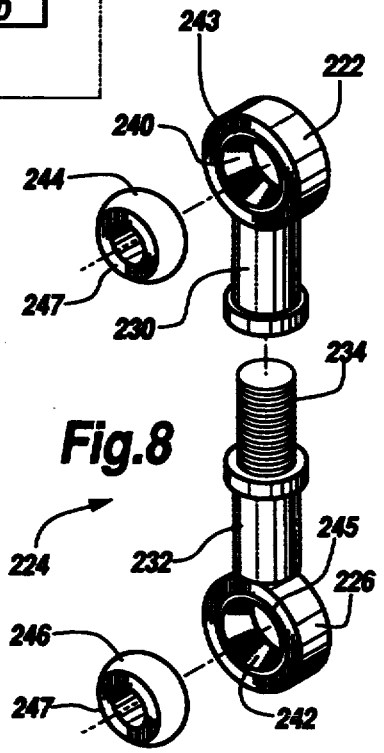
FIG. 8 is an exploded perspective view of the lift link the three-function control mechanism of FIG. 3.

With reference to FIG. 8, both the upper and lower swivel link parts 230 and 232 have respective apertures 240 and 242 in which respective bushings 243 and 245 are fitted. The internal surfaces of the bushings 243 and 245 convex, preferably substantially following the contour of the inside of a truncated sphere. In addition, each of the apertures 240 and 242 holds a respective truncated, universal ball bearing 244 and 246 that can freely rotate in any direction within its respective aperture 240 and 242. The sides 247 of the truncated ball bearings 244 and 246 protrude out of the apertures 240 and 242.

The truncated ball bearings 244 and 246 each have a through hole 248 and 250. The through hole 248 of the upper truncated ball bearing 244 receives a lube fitting 252 that couples the upper swivel link part 230 to the tab member 220. The fitting 252 essentially holds the upper ball bearing fixed with respect to the tab member 220 while allowing the upper end 222 freedom to rotate or swivel about the upper ball bearing 244 if necessary, thereby generally forming an upper swivel joint 223. Spacers (not shown) can, if desired, be positioned on either side of the ball bearing to assist in coupling the upper end 222 of the link 224 to the tab member 220.

The through hole 250 of the lower truncated ball beating 256 receives a pin 254 that couples the lower swivel link part 232 to a clevised upper end 228 of the lift spool 104. The lower truncated ball bearing 246 likewise is held essentially fixed with respect to the clevised upper end 228 of the lift spool 104 while the lower end 226 of the lift link 224 is allowed to rotate about the lower ball bearing 246, thereby generally forming a lower swivel joint 225. Spacers (not shown) can also be employed in coupling the lower ball bearing 246 to the upper end 228 of the lift spool 104. The upper and lower swivel joints are further discussed below in connection with the tilt function of the control mechanism 10.

Figure 7A:
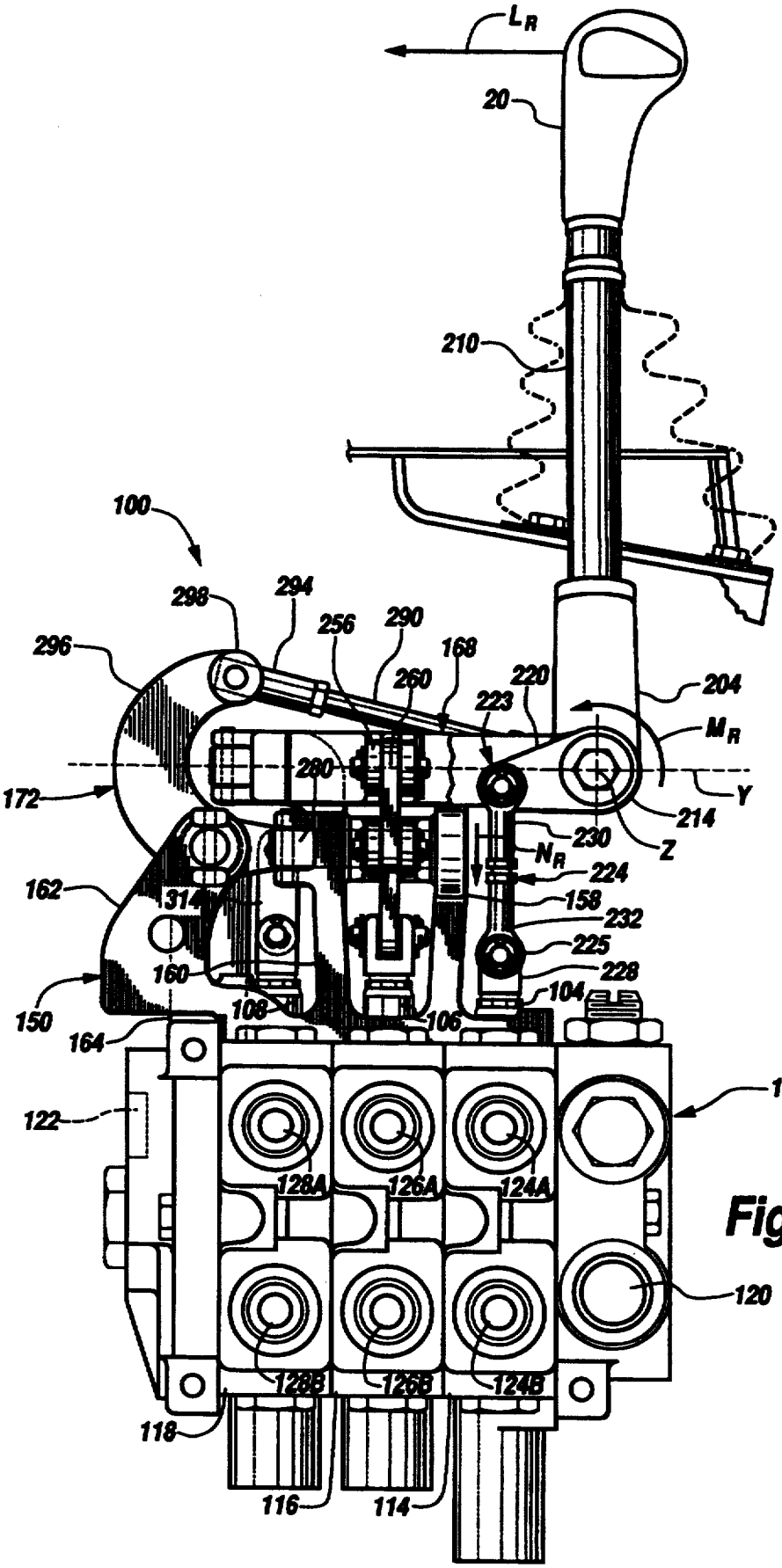
FIG. 7A is a cut-away, side elevational view of the three-function control mechanism of FIG. 3 illustrating a rearward position of the operator handle.

With reference to FIG. 7A, the lift spool 104 may be lowered (and blade 18 consequently raised) by moving the handle 20 and shaft 210 rearward as indicated by arrow $L_R$. Lift bellcrank 174 in turn rotates counterclockwise about pin 218 as indicated by arrow $M_R$ with respect to the lift and tilt bellcrank 168. As the lift bellcrank 174 turns counterclockwise, the tab member 220 moves downwardly pushing the lift link 224 and upper end 228 of the lift spool 104 downward as well, as indicated by arrow $N_R$.

Figure 7B:
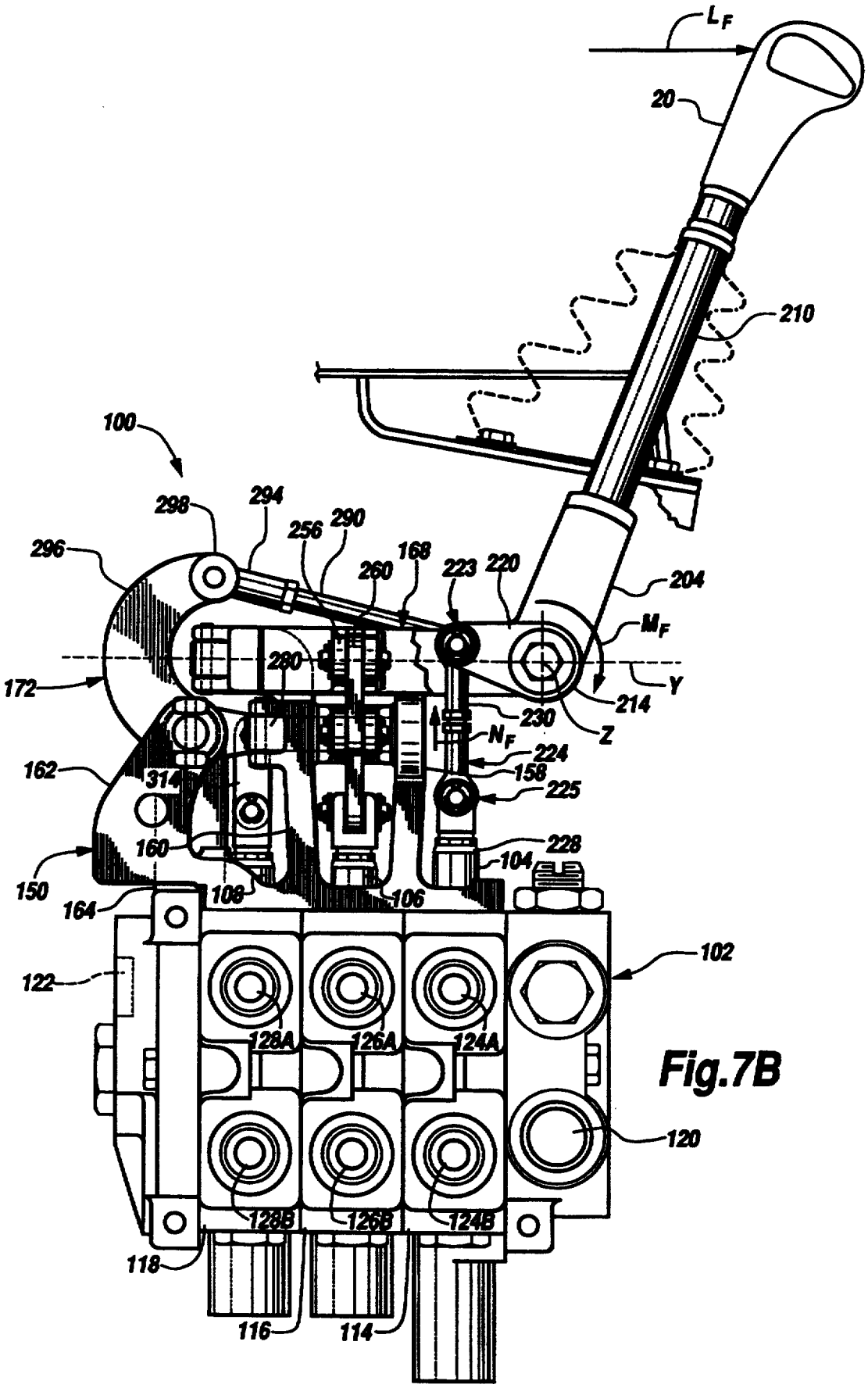
FIG. 7B is a cut-away, side elevational view of the three-function control mechanism of FIG. 3 illustrating a forward position of the operator handle.

With reference to FIG. 7B, the lift spool 104 may be raised (and blade 18 consequently lowered) by moving the handle 20 and shaft 210 forward as indicated by arrow $L_F$. Lift bellcrank 174 in turn rotates clockwise about pin 218 as indicated by arrow $M_F$ with respect to the lift and tilt bellcrank 168. As the lift bellcrank 174 turns clockwise, the tab member 220 moves upwardly pulling the lift link 224 and upper end 228 of the lift spool 104 upward as well as indicated by arrow $N_F$.

B. The Tilt Function

With reference to FIGS. 6, 9A–C, 10A–C, and 11, the tilt function of the control mechanism 100 will now be described in more detail. Both the lift and tilt bellcrank 168 and the tilt bellcrank 170 are associated with the tilt function. The lift and tilt bellcrank 168 is provided with a clevised tab member 256 projecting from the side of the bellcrank's tubular member 184. A first end 258 of a first tilt link 260 is pivotably mounted to the clevised tab member 256 by a pin 262. An opposite second end 264 of the first tilt link 258 is pivotably mounted to the tilt bellcrank 170.

The tilt bellcrank 170 is provided with opposing clevised portions 266 and 268. The first clevised portion 266 receives the opposite end 264 of the first tilt link 258, and the second clevised portion receives one end 270 of a second tilt link 272. The opposite end 274 of the second tilt link 272 is coupled to an upper clevised end 276 of the tilt spool 106.

The tilt bellcrank 170 also has a central through hole 278 and is pivotably mounted between the first and second support members 158 and 160 of the control bracket 150. In particular, the tilt bellcrank 170 is mounted between the side projection 190 of the first support member 158 and the side projection 196 of the second support member 160. A pin 280 passing through the hole 278 of the tilt bellcrank and the apertures 194 and 198 of the side projections 190 and 196 holds the tilt bellcrank 170 in position.

Figure 9A:
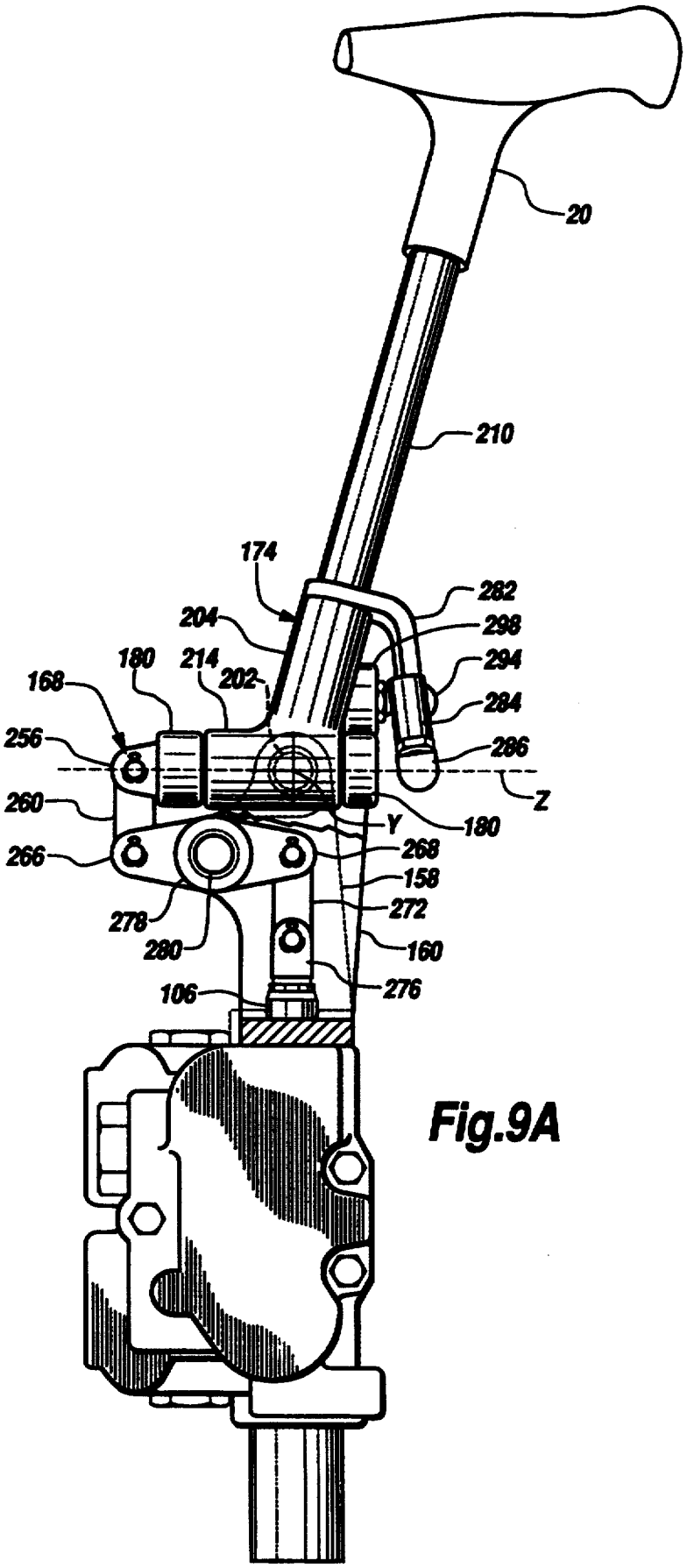
FIG. 9A is a cut-away, right end elevational view of the three-function control mechanism of FIG. 3 with the lift link removed.
Figure 9B:
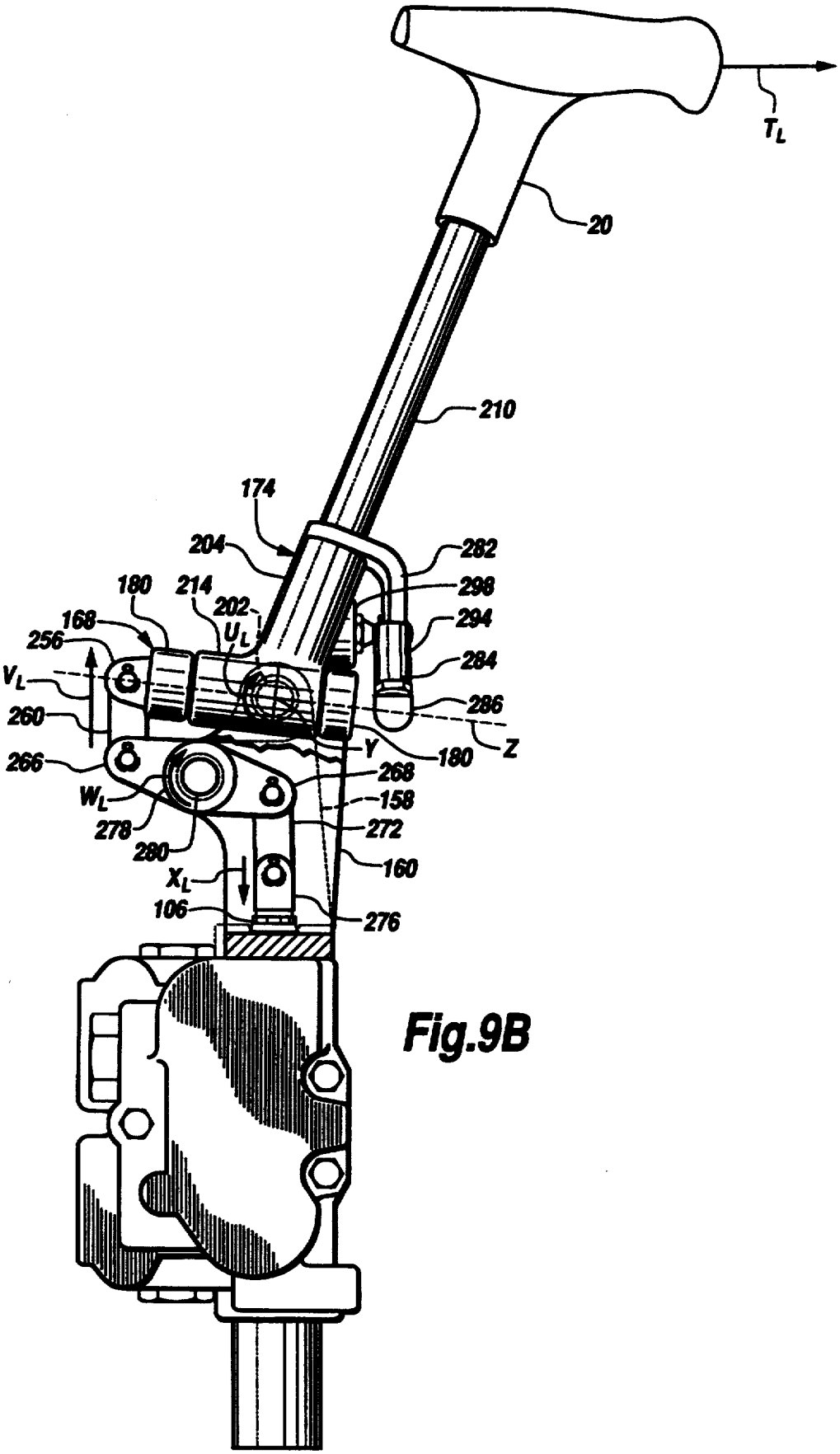
FIG. 9B is a cut-away, right end elevational view similar to FIG. 9A, illustrating a left position of the operator handle as viewed by the operator (a right position as viewed in FIG. 9B)

In order to tilt the blade, i.e., raise or lower the left upper corner 86 of the blade 18 so that the blade rotates about axis B, the operator moves the handle 20 to his or her right or left. Referring to FIG. 9B, when the handle 20 is moved to the operator's left as indicated by arrow $T_L$ (the right as viewed in FIG. 9B), the lift bellcrank 174 also moves to the operator's left causing the lift and tilt bellcrank 168 to rotate clockwise (as viewed in FIG. 9B) about pin 202 as indicated by arrow $U_L$. The pivot axis of the pin 202 is represented by axis Y throughout the drawings. The clevised tab member 256 of the lift and tilt bellcrank 260 in turn moves upwardly, pulling the first tilt link 260 upward also as indicated by arrow $V_L$. The first clevised part 266 of the tilt bellcrank 170 moves upward, and the entire tilt bellcrank 170 rotates clockwise (as viewed in FIG. 9B) about the pin 280 as indicated by arrow $W_L$. The second clevised part 268 of the tilt bellcrank 170 moves downward forcing the upper end 276 of the tilt spool 106 downward as well, as indicated by arrow $X_L$.

Figure 9C:
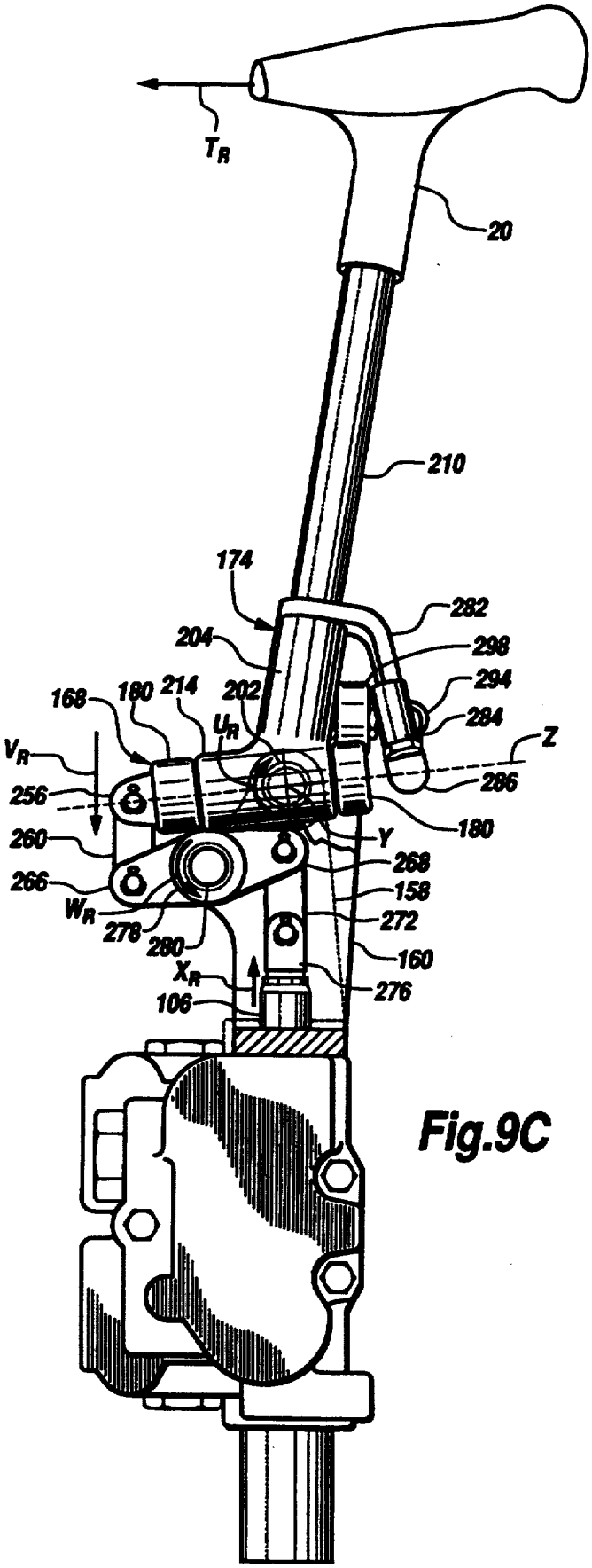
FIG. 9C is a right end elevational view similar to FIG. 9A, illustrating a right position of the operator handle as viewed by the operator (a left position as view in FIG. 9C)

Referring to FIG. 9C, when the handle 20 is moved to the operator's right as indicated by arrow $T_R$ (the left as viewed in FIG. 9C), the lift bellcrank 174 also moves to the operator's right causing the lift and tilt bellcrank 168 to rotate counterclockwise (as viewed in FIG. 9C) about pin 202 (and axis Y) as indicated by arrow $U_R$. The devised tab member 256 of the lift and tilt bellcrank 260 in turn moves downwardly, pushing the first tilt link 260 downward, also as indicated by arrow $V_R$. The first clevised part 266 of the tilt bellcrank 170 moves downward, and the entire tilt bellcrank 170 rotates counterclockwise (as viewed in FIG. 9C) about the pin 280 as indicated by arrow $W_R$. The second clevised part 268 of the tilt bellcrank 170 moves upward pulling the upper end 276 of the tilt spool 106 downward as well as indicated by arrow $X_R$.

As mentioned above, when the handle 20 and handle shaft 210 are moved sideways to the left or right, the lift bellcrank 174 likewise moves since the handle shaft 210 is mounted within the bore 206 of the lift bellcrank 174. The lift bellcrank 174 rotates with the lift and tilt bellcrank 168 about axis Y. As the lift bellcrank 174 rotates about axis Y, however, the projecting tab member 220 which is coupled to the lift link 224 also rotates about axis Y.

Figure 10C:
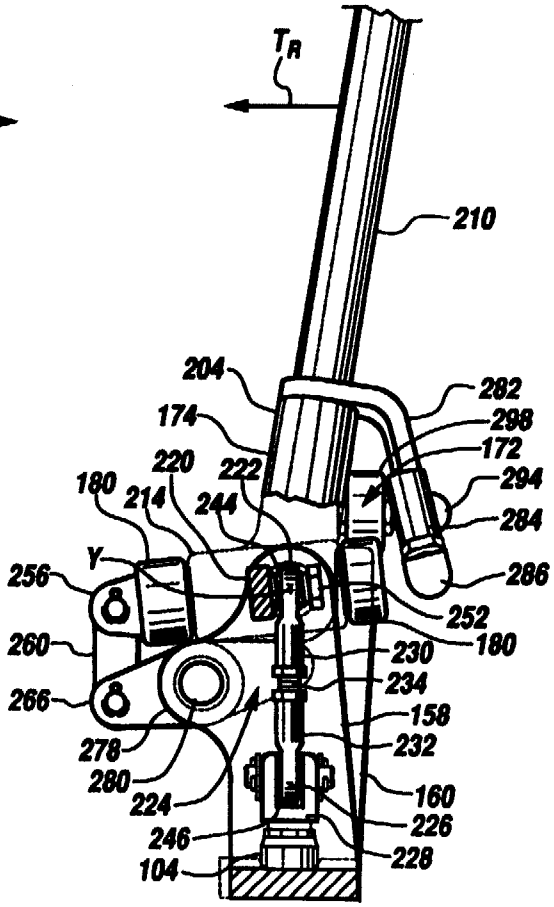
FIG. 10C is a cut-away right end elevational view of the three-function control mechanism of FIG. 3 with the lift link shown, illustrating the right position of the operator handle as viewed by the operator (a left position as viewed in FIG. 10C)
Figure 10B:
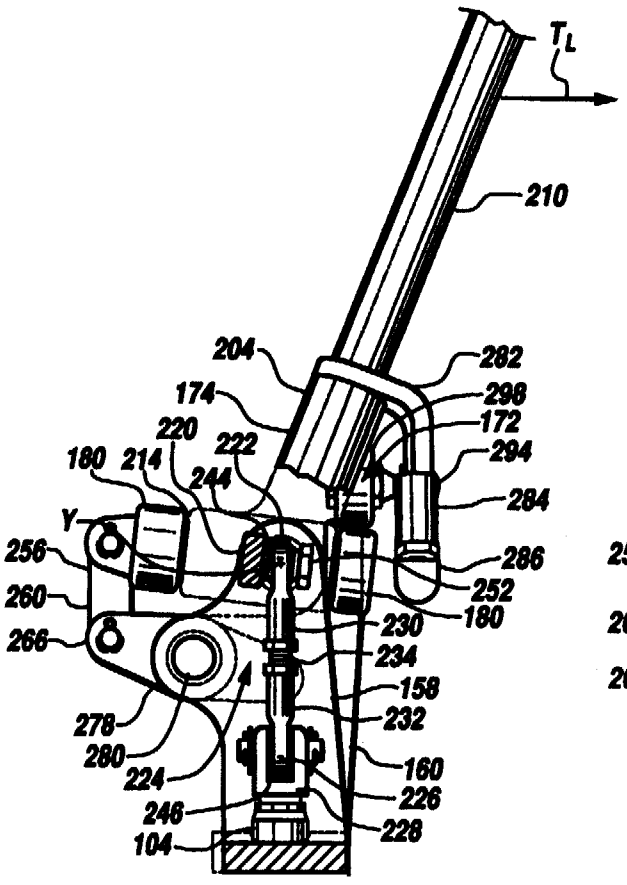
FIG. 10B is a cut-away, right end elevational view of the three-function control mechanism of FIG. 3 with the lift link shown, illustrating the left position of the operator handle as viewed by the operator (a right position as viewed in FIG. 10B)
Figure 10A:
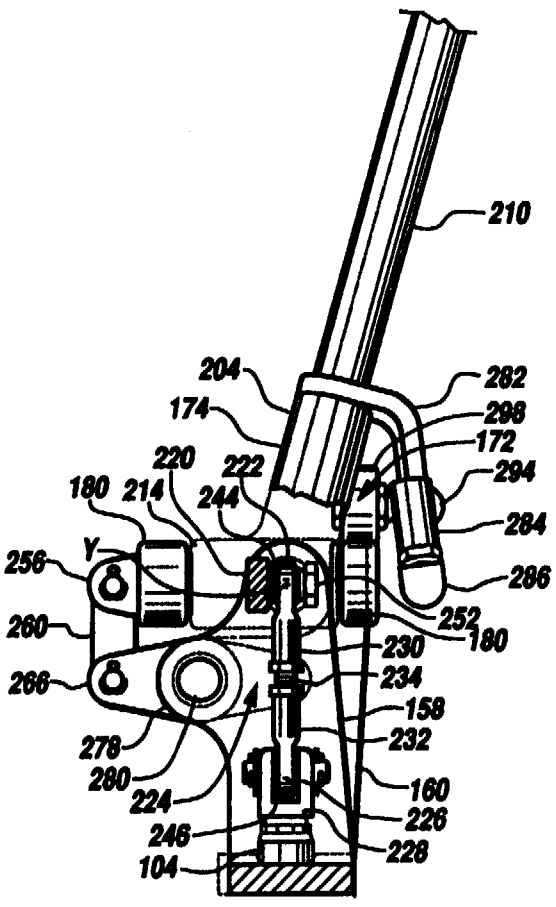
FIG. 10A is a cut-away, right end elevational view of the three-function control mechanism of FIG. 3 with the lift link shown.
Figure 11:
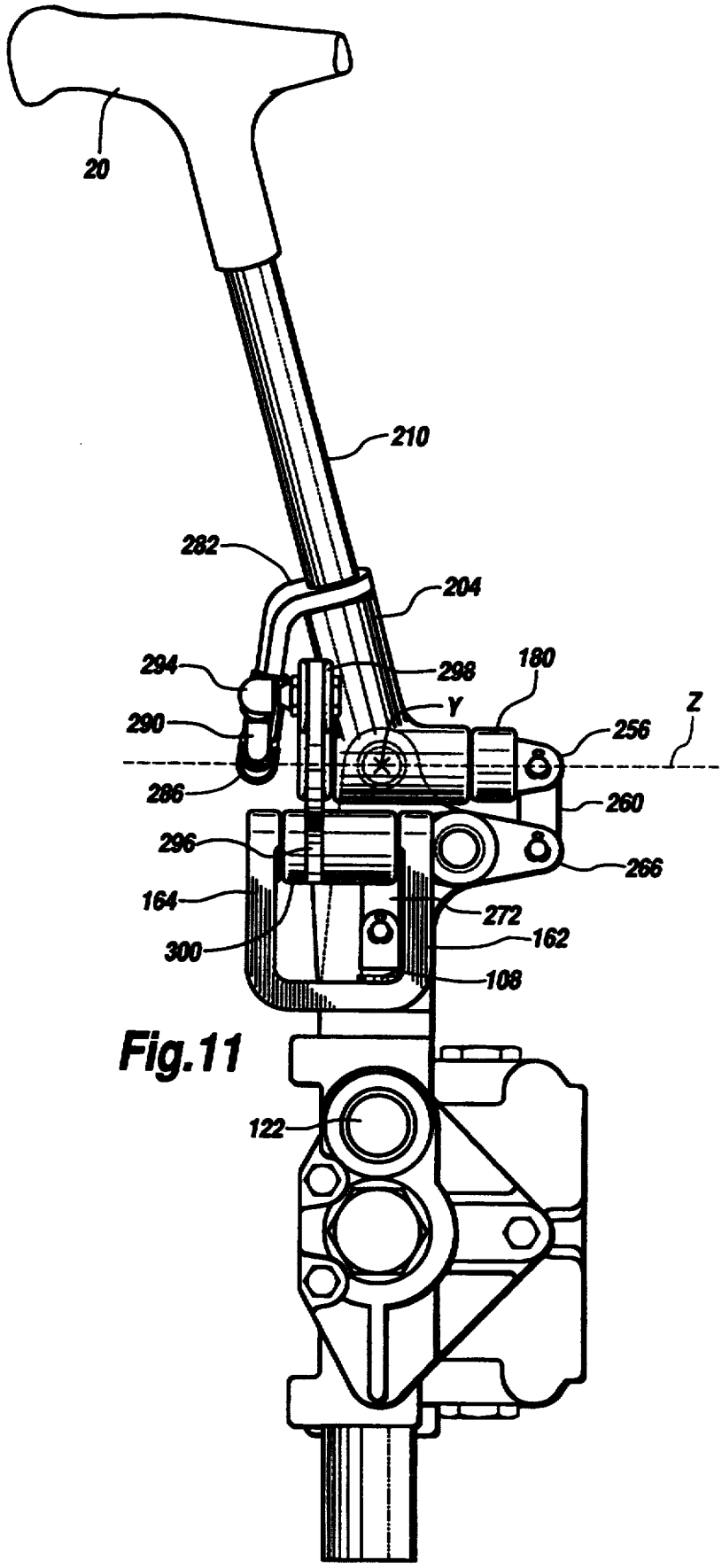
FIG. 11 is a left end elevational view of FIG. 3 with some of the components removed for clarity.

FIGS. 10A, 10B, and 10C illustrate the effect the position of the handle shaft 210 has on the lift link 224 connected to the projecting tab member 220. In FIG. 10A the handle shaft 210 is shown in its normal upright position. In FIG. 10B, the handle shaft 210 is shown moved to the operator's left as indicated by arrow $T_L$ (the right as viewed in FIG. 10B), and in FIG. 10C the handle shaft 210 is shown moved to the operator's right as indicated by arrow $T_R$ (the left as viewed in FIG. 10C).

Although the upper end 222 of the lift link 224 is coupled to the tab member 220, the tab member 220 is not restrained from moving with the lift bellcrank 174 by the lift link 224. Nor, in general, is the upper end 222 of the lift link forced to move with the tab member 220. This is due to the presence of the upper and lower swivel joints 223 and 225.

With reference to FIGS. 10B and 10C, as the tab member 220 moves with the lift bellcrank 174 about axis Y, the upper truncated ball bearing 244 rotates in the upper end 222 of the lift link 224 also about axis Y. The upper end 222 of the lift link 224, however, remains essentially stationary. Preferably, the upper swivel joint 223, and in particular, the upper truncated ball bearing 244 is substantially aligned with the Y axis, when the handle 20 is not moved into its forward or rearward positions (as shown in FIGS. 7A and 7B). Accordingly, the pin 202 and the upper truncated ball beating 244 both lie substantially on the Y axis. This alignment allows the upper end 222 of the lift link 224 to remain stationary while the upper truncated ball bearing 244 rotates within the upper aperture 240 when the handle 20 and handle shaft 210 are moved to either the left of right as shown in FIGS. 10A and 10B.

If, however, the handle 20 is moved forward or rearward (as shown in FIGS. 7A and 7B), the upper ball bearing 244 will no longer be aligned with the Y axis. Consequently, if the handle 20 is then moved to the left or fight (while still in a forward or rearward position), the upper end 222 of the lift link 224 will be forced to move in a small arc about the Y axis along with the tab member 220 (and upper ball bearing 244). As the upper end 222 moves in the arc, the upper ball bearing will rotate within the upper aperture 240; the lower end 226, however, will rotate about the lower ball bearing 246 which is fixed to the upper devised end 228 of the lift spool 104. The rotating movement of the lower end 226 about the lower ball bearing 246, however, results in substantially no or little up or down movement of the lift spool 104.

As can be appreciated from the foregoing discussion, the configuration of the lift link 224, with the two ball bearing 244 and 246, as well as the position of the lift link 224 with the upper ball bearing 244 aligned with the Y axis, allows side-to-side movement of the handle 20 without substantially effecting the lift spool position.

C. The Angle Function

Figure 5B:
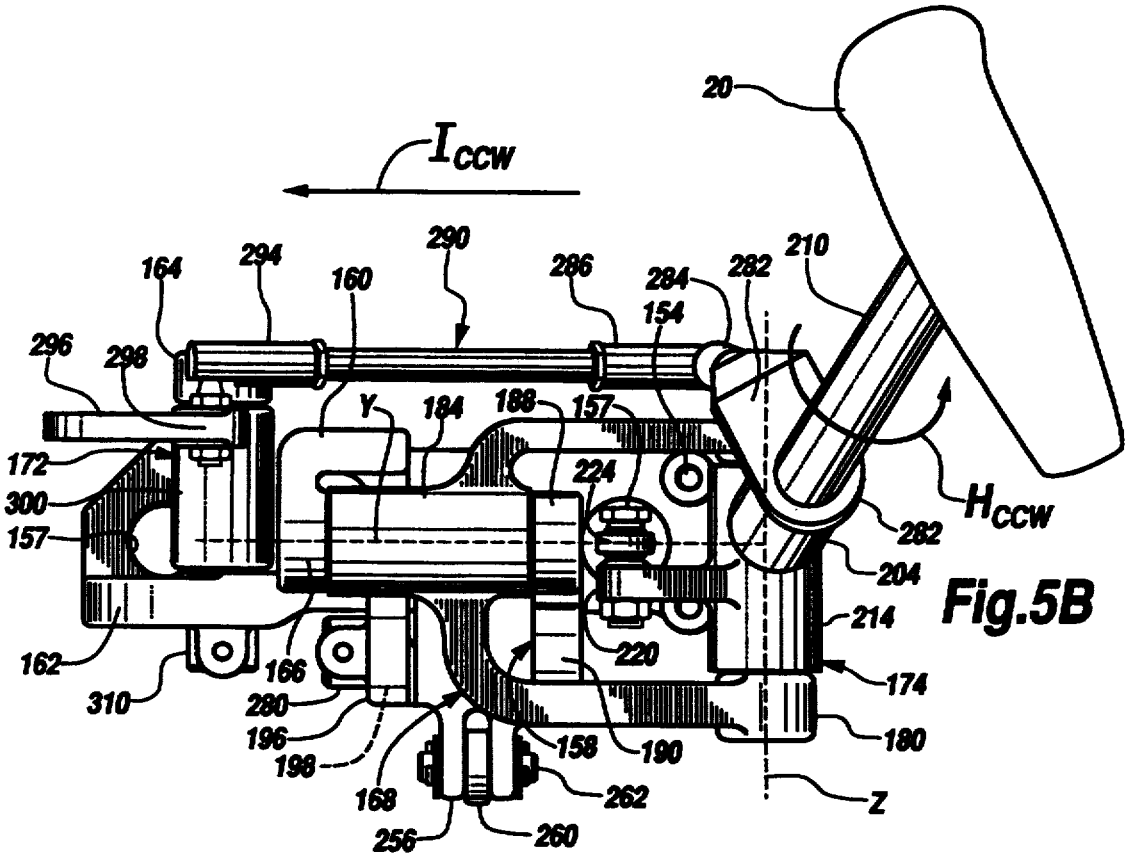
FIG. 5B is a top plan view of the three-function control mechanism of FIG. 3 illustrating the operator handle twisted counterclockwise.
Figure 12A:
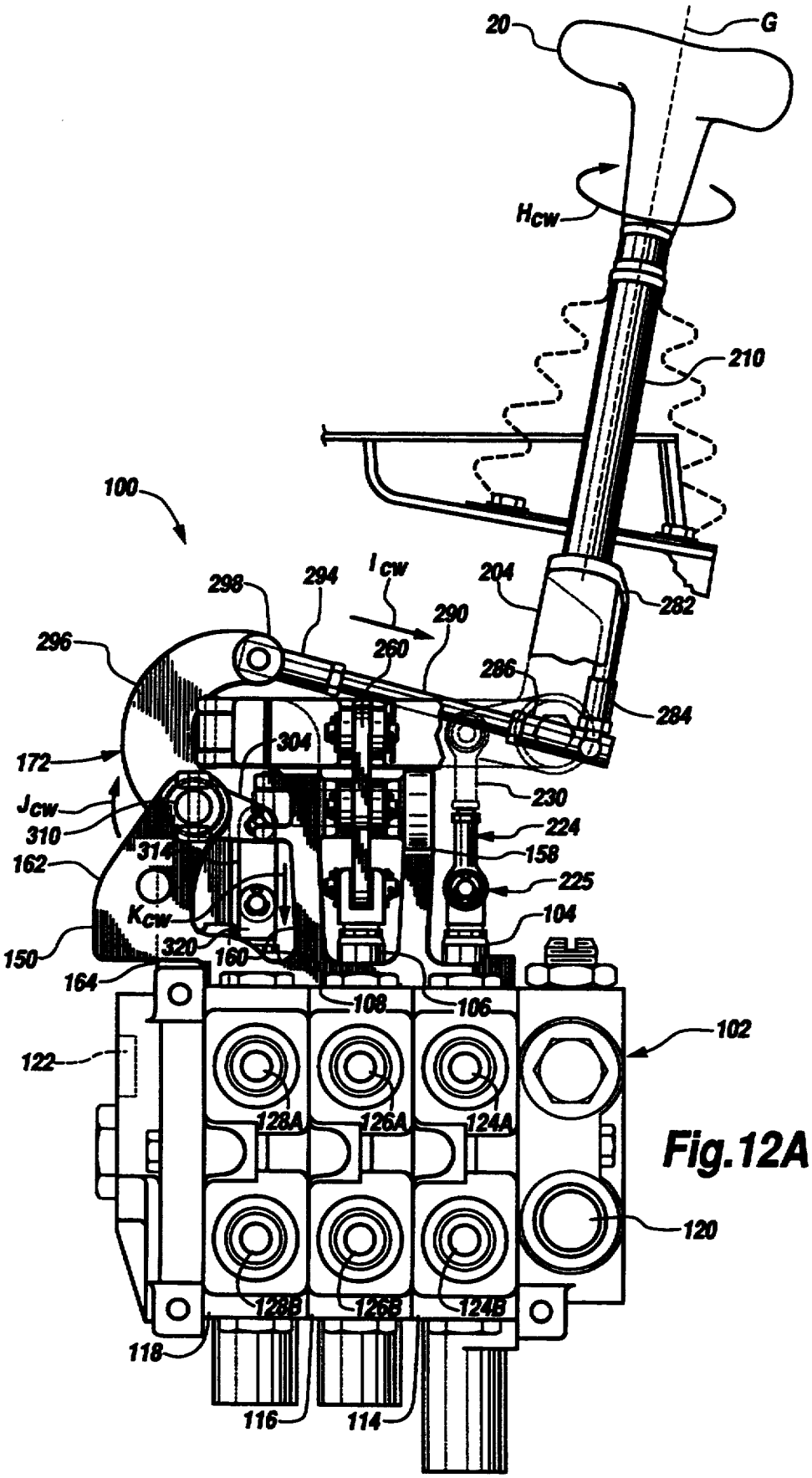
FIG. 12A is a cut-away, side elevational view of the three-function control mechanism of FIG. 3 illustrating the operator handle twisted clockwise.
Figure 12B:
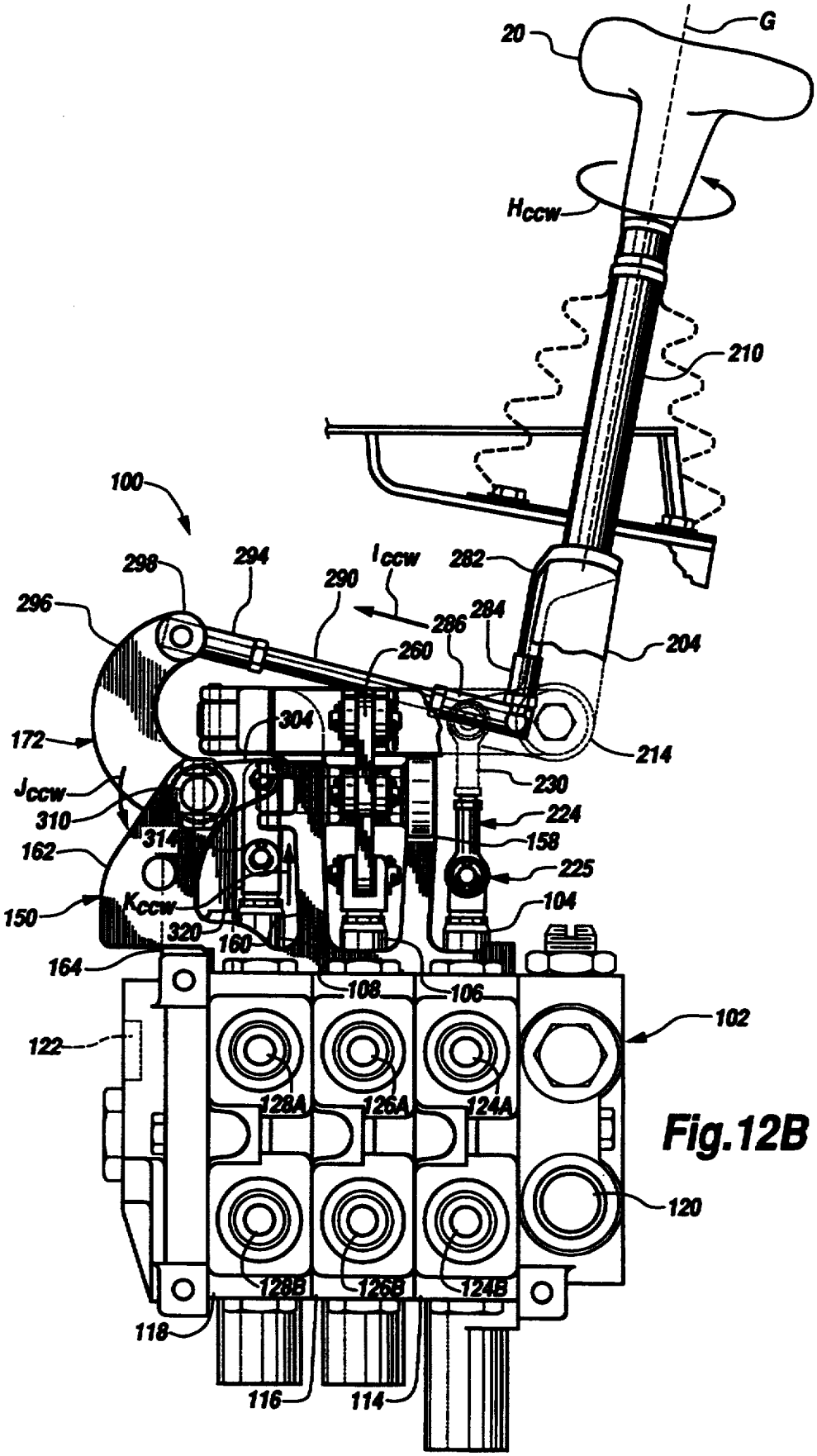
FIG. 12B is a cut-away, side elevational view of the three-function control mechanism of FIG. 3 illustrating the operator handle twisted counterclockwise.

The angle function of the control mechanism 100 will now be described in more detail. With reference to FIGS. 5A, 5B, 6, 11, 12A, and 12B, angling of the blade 18 to the left or right is accomplished by twisting the handle 20 clockwise or counterclockwise about axis G extending longitudinally through the center of the handle shalt 210. FIGS. 5A and 12A illustrate the handle 20 twisted clockwise as indicated by arrow $H_{CW}$. FIGS. 5B and 12B illustrate the handle 20 twisted counterclockwise as indicated by arrow $H_{CCW}$. Fixed to the handle shaft 210 is a bent control lever 282 that extends outwardly to the side and then downward. Threadingly attached to the end 284 of the control lever 282 is a first fight-angle ball joint 286. The first right-angle ball joint 286 is also threadingly attached to a first end 288 of a threaded rod 290. The rod 290 extends rearwardly at an angle and has a second end 292 to which a second right-angle ball joint 294 is attached.

The second right-angle ball joint 294 is also attached to the angle bellcrank 172. The angle bellcrank 172 has a C-shaped portion 296 with one end 298 attached to the second right-angle ball joint 294. The angle bellcrank 172 also has a tubular portion 300 formed at the other end of the C-shaped portion. A through hole 302 passes through the tubular portion 300, and a clevised tab member 304 extends from the side of the tubular member 300.

The tubular portion 300 of the angle bellcrank 172 is positioned between the third and fourth support members 162 and 164 of the control bracket 150. Each of the support members 162 and 164 has a respective aperture 306 and 308. A pin 310 passing through the apertures 306 and 308 and the through hole 302 of the tubular portion 300 holds the angle bellcrank 172 pivotably in position.

A first end 3 12 of an angle link 314 is pivotably attached to the clevised tab member 304 and is held in place by a pin 316. The second end 318 of the angle link 314 is coupled to the upper end 320 of the angle spool 108.

With reference to FIGS. 5A and 12A, when the handle 20 is twisted clockwise, the control lever 282 turns with the shaft 2 10 and pushes the rod 290 forward at an angle as indicated by arrow $I_{CW}$. The rod 290 in turn causes the angle bellcrank 172 to rotate clockwise about pin 310 as indicated by arrow $J_{CW}$. As the angle bellcrank 172 rotates clockwise, the clevised tab member 304 moves downwardly pushing the upper end 320 of the angle spool 108 downward as indicated by arrow $K_{CW}$.

With reference to FIGS. 5B and 12B, when the handle 20 is twisted counterclockwise, the control lever 282 turns with the shaft 210 and pushes the rod 290 rearward at an angle as indicated by arrow $I_{CCW}$. The rod 290 in turn causes the angle bellcrank 172 to rotate counterclockwise about pin 310 as indicated by arrow $J_{CCW}$. As the angle bellcrank 172 rotates counterclockwise, the clevised tab member 304 moves upwardly pushing the upper end 320 of the angle spool 108 upward as indicated by arrow $K_{CCW}$.

Shaft bearings 322 (shown in FIG. 6) are provided in the bore 206 of the lift bellcrank 174 so that when the handle 20 and handle shaft 210 are twisted, the lift bellcrank 174 (and consequently the lift and tilt bellcrank 168 and the tilt bellcrank 170) remain stationary. Furthermore, when the handle 20 and handle shaft 210 are moved to the left or right (as illustrated in FIGS. 9B, 9C, 10B, and 10C), the first and second ball joints 286 and 294 allow the control lever 282 and rod 290 to move with the handle shaft 210 without causing the angle bellcrank 172 to move. The first ball joint 286 allows relative pivoting of the control lever 282 with respect to the rod 290, and the second ball joint 294 allows relative pivoting of the rod 290 with respect to the bellcrank 172.

In addition, the first ball joint 286 is preferably aligned with pin 218 (extending through the hole 216 of the lift bellcrank 174 and the apertures 182 of the lift and tilt bellcrank 168) so that the pin 218 and the ball 324 of the first ball joint 286 both lie substantially on the Z axis. With the first ball joint 286 thus aligned, the control lever 282 can rotate with the handle shaft 210 about the pin 218 (Y axis), without pulling or pushing the rod 288, when the handle 20 and handle shaft 210 are moved forward or backward (as illustrated in FIGS. 7A and 7B). Accordingly, movement of the handle 20 and handle shaft 210 forward or backward will not cause the angle bellcrank 172 to move.

Shaft beatings 326 are preferably provided for the cross-leg hole 216 of the lift bellcrank 174 so that the lift bellcrank 174 can freely move without causing the lift and tilt bellcrank to move when the handle 20 and handle shaft 210 are moved forward or backward.

With the above-described three-function control mechanism 100, an operator of the bulldozer 10 can individually or simultaneously lift, tilt, or angle the blade 18. The operator can merely move a single handle 20 forward or backward, and/or side-to-side, and/or clockwise or counterclockwise and thereby actuate individually or simultaneously corresponding valve spools 104, 106, and 108. Movement of the handle in one of the aforementioned directions, however, will only cause the corresponding valve spool to move and will not effect the other valve spools.

While only one embodiment of the invention has been shown and described, it should be recognized that other variations, substitutions, or modifications will occur to those skilled in the art. For example, the control mechanism may be used in an environment other than a vehicle such as the bulldozer described herein. Furthermore, if the control mechanism is used with a bulldozer or a like vehicle, the hydraulic valve unit may have a different configuration or there may be fewer or more hydraulic cylinders than described herein. Any such variations, substitutions, and modification are intended to fall within the scope of the invention as defined in the appended claims.

We claim:

1. A three-function control mechanism for controlling a first, a second and a third actuator, said three function control mechanism comprising:

a control bracket;

a control lever comprising a handle shaft having a first end and a second end;

a first bellcrank, said first end of said handle shaft being rotatably mounted to said first bellcrank such that said handle shaft can rotate about a first axis;

a second bellcrank rotatably mounted to said first bellcrank such that said first and said second bellcranks can each rotate about a second axis with respect to one another, said second bellcrank further being rotatably mounted to said control bracket such that said second bellcrank can rotate about a third axis with respect to said control bracket;

a third bellcrank pivotably coupled to said second bellcrank, said third bellcrank further being rotatably mounted to said control bracket such that said third bellcrank can rotate about a fourth axis with respect to said control bracket;

a fourth bellcrank pivotably coupled to said handle shaft, said fourth bellcrank further being rotatably mounted to said control bracket such that said fourth bellcrank can rotate about a fifth axis with respect to said control bracket;

first linkage having a first end and a second end, wherein said first end of said first linkage is mounted to said first bellcrank and said second end of said first linkage is adapted to be coupled to said first actuator;

second linkage having a first end and a second end, wherein said first end of said second linkage is mounted to said third bellcrank and said second end of said second linkage is adapted to be coupled to said second actuator; and third linkage having a first end and a second end, wherein said first end of said third linkage is mounted to said fourth bellcrank and said second end of said third linkage is adapted to be coupled to said third actuator;

wherein said control lever may be moved in first and second opposing directions such that said control lever and said first bellcrank rotate about said second axis causing said first linkage to move, wherein said control lever may be moved in third and fourth opposing directions such that said control lever and second bellcrank rotate about said third axis causing said third bellcrank and said second linkage to move, and wherein said control lever may be moved in fifth and sixth opposing directions such that said control lever rotates about said first axis causing said fourth bellcrank and third linkage to move.

2. The three-function control mechanism of claim 1, wherein said first linkage comprises a link, a first swivel joint postioned at said first end of said first linkage interconnecting said link and said first bellcrank, and a second swivel joint postioned at said second end of said first linkage interconnecting said link and said first actuator.

3. The three-function control mechanism of claim 2, wherein said first swivel joint is substantially aligned with said third axis except when said control lever is moved in either said first or second direction away from a neutral position wherein the control lever has not been moved in any direction.

4. The three-function control mechanism of claim 1, wherein said first end of said first linkage has a first aperture provided with a first bearing assembly and said first bellcrank has an aperture, said three-function control mechanism further comprising a first pin passing through said first aperture of said first linkage and said aperture of said first bellcrank thereby connecting said first bellcrank and said first linkage.

5. The three-function control mechanism of claim 4, wherein said second end of said first linkage has a second aperture provided with a second bearing assembly and said first actuator has an aperture, said three-function control mechanism further comprising a second pin passing through said second aperture of said first linkage and said aperture of said first actuator thereby connecting said first linkage and said first actuator.

6. The three-function control mechanism of claim 5, wherein said first bearing assembly comprises a bearing surface provided on an interior surface of said first aperture of said first linkage and a first ball bearing positioned in said first aperture, said first ball beating having a through hole, wherein said first pin passes through said through hole of said first ball bearing; and wherein said second bearing assembly comprises a bearing surface provided on an interior surface of said second aperture of said first linkage and a second ball bearing positioned in said second aperture, said second ball bearing having a through hole, wherein said second pin passes through said through hole of said second ball bearing.

7. The three-function control mechanism of claim 1, further comprising:

a rod assembly interconnecting said handle shaft and said fourth bellcrank, said rod assembly comprising a rod having a first end and a second end, a first ball joint provided on said first end of said rod, and a second ball joint provided on said second end of said rod; and a handle shaft bracket mounted to and extending from said handle shaft;

wherein said first ball joint is attached to said handle shaft bracket and said second ball joint is attached to said fourth bellcrank.

8. The three-function control mechanism of claim 6, wherein said first ball joint is substantially aligned with said second axis.

9. The three-function control mechanism of claim 1, wherein said second and third axes are substantially mutually perpendicular.

10. The three-function control mechanism of claim 1, wherein said control bracket comprises a base portion and first, second, third, and fourth supporting members extending outwardly from said base portion;

wherein at least a portion of said second bellcrank is mounted between said first and second supporting members;

wherein at least a portion of said third bellcrank is mounted between said first and second supporting members; and wherein at least a portion of said fourth bellcrank is mounted between said third and fourth supporting members.

11. A work vehicle comprising:

a supporting body;

driving means coupled to said supporting body for propelling the supporting body;

a working member coupled to said supporting body;

at least three actuators operatively coupled to said working member for adjusting the position of said working member; and a control mechanism operatively coupled to said actuators for controlling said actuators, said control mechanism comprising:

a control bracket;

a control lever comprising a handle shalt having a first end and a second end;

a first bellcrank, said first end of said handle shaft being rotatably mounted to said first bellcrank such that said handle shaft can rotate about a first axis;

a second bellcrank rotatably mounted to said first bellcrank such that said first and said second bellcranks can each rotate about a second axis with respect to one another, said second bellcrank further being rotatably mounted to said control bracket such that said second bellcrank can rotate about a third axis with respect to said control bracket;

a third bellcrank pivotably coupled to said second bellcrank, said third bellcrank further being rotatably mounted to said control bracket such that said third bellcrank can rotate about a fourth axis with respect to said control bracket;

a fourth bellcrank pivotably coupled to said handle shaft, said fourth bellcrank further being rotatably mounted to said control bracket such that said fourth bellcrank can rotate about a fifth axis with respect to said control bracket;

first linkage having a first end and a second end, wherein said first end of said first linkage is mounted to said first bellcrank and said second end of said first linkage is coupled to said first actuator;

second linkage having a first end and a second end, wherein said first end of said second linkage is mounted to said third bellcrank and said second end of said second linkage is coupled to said second actuator; and third linkage having a first end and a second end, wherein said first end of said third linkage is mounted to said fourth bellcrank and said second end of said third linkage is coupled to said third actuator;

wherein said control lever may be moved in first and second opposing directions such that said control lever and said first bellcrank rotate about said second axis causing said first linkage and said first actuator to move, wherein said control lever may be moved in third and fourth opposing directions such that said control lever and second bellcrank rotate about said third axis causing said third bellcrank, said second linkage and said second actuator to move, and wherein said control lever may be moved in fifth and sixth opposing directions such that said control lever rotates about said first axis causing said fourth bellcrank, third linkage and said third actuator to move.

12. The work vehicle of claim 11, wherein said first actuator comprises a first hydraulic valve and at least one hydraulic cylinder operatively coupled to both said first hydraulic valve and said working member, said second actuator comprises a second hydraulic valve and at least one hydraulic cylinder operatively coupled to both said second hydraulic valve and said working member, and said third actuator comprises a third hydraulic valve and at least one hydraulic cylinder operatively coupled to both said third hydraulic valve and said working member;

whereby extension or retraction of said hydraulic cylinder of said first actuator causes said working member to raise or lower, extension or retraction of said hydraulic cylinder of said second actuator causes said working member to tilt about a tilt axis, and extension or retraction of said hydraulic cylinder of said third actuator causes said working member to angle about an angle axis.

13. The work vehicle of claim 12, wherein said first, second, and third hydraulic valves each are provided with a respective valve spool, said valve spools being substantially aligned in a row; and wherein one end of said valve spool of said first hydraulic valve is mounted to said second end of said first linkage, one end of said valve spool of said second hydraulic valve is mounted to said second end of said second linkage, and one end of said valve spool of said third hydraulic unit is mounted to said second end of said third linkage.

* * * * *